US008920187B2

(12) United States Patent
Kon et al.

(10) Patent No.: US 8,920,187 B2
(45) Date of Patent: Dec. 30, 2014

(54) CONNECTOR AND CONNECTOR ASSEMBLY

(71) Applicant: Sumitomo Wiring Systems, Ltd., Yokkaichi (JP)

(72) Inventors: Akihiro Kon, Yokkaichi (JP); Yutaka Noro, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 59 days.

(21) Appl. No.: 13/761,219

(22) Filed: Feb. 7, 2013

(65) Prior Publication Data

US 2013/0237084 A1 Sep. 12, 2013

(30) Foreign Application Priority Data

Mar. 9, 2012 (JP) ..... 2012-052797

(51) Int. Cl.
*H01R 13/627* (2006.01)
*H01R 13/641* (2006.01)

(52) U.S. Cl.
CPC ..... *H01R 13/641* (2013.01); *H01R 13/6272* (2013.01)
USPC ..... 439/354; 439/489; 439/352

(58) Field of Classification Search
USPC ..... 439/350–358, 489
See application file for complete search history.

(56) References Cited

U.S. PATENT DOCUMENTS 4,950,179 A * 8/1990 Takenouchi et al. ..... 439/352
5,120,255 A * 6/1992 Kouda et al. ..... 439/489
5,330,369 A * 7/1994 Nozaki et al. ..... 439/489
5,507,666 A * 4/1996 Yamanashi ..... 439/489
5,803,651 A * 9/1998 Saito ..... 403/329
5,839,915 A * 11/1998 Ford et al. ..... 439/489
5,879,180 A * 3/1999 Iwahori et al. ..... 439/352
5,910,027 A * 6/1999 Wayt et al. ..... 439/489
5,910,028 A * 6/1999 Tsuji ..... 439/489
6,022,238 A * 2/2000 Tomita et al. ..... 439/352
6,045,388 A * 4/2000 Higgins et al. ..... 439/352
6,109,955 A * 8/2000 Hanazaki et al. ..... 439/489
6,261,116 B1 * 7/2001 Ceru ..... 439/352
6,354,860 B1 * 3/2002 Miller et al. ..... 439/352
6,435,895 B1 * 8/2002 Fink et al. ..... 439/352
6,439,915 B2 * 8/2002 Kurimoto ..... 439/352
6,514,099 B2 * 2/2003 Endo ..... 439/489
6,572,400 B2 * 6/2003 Noguchi et al. ..... 439/489
6,712,635 B1 * 3/2004 Nimura ..... 439/352
6,824,417 B1 * 11/2004 Nimura ..... 439/352
6,824,421 B2 * 11/2004 Oka ..... 439/489
6,857,892 B2 * 2/2005 McLauchlan et al. ..... 439/352
7,399,195 B2 * 7/2008 Kim et al. ..... 439/352
7,476,123 B2 * 1/2009 Kobayashi et al. ..... 439/489
7,909,638 B2 * 3/2011 Seo et al. ..... 439/489
7,980,887 B2 * 7/2011 Urano et al. ..... 439/489
2004/0023547 A1 * 2/2004 Oka ..... 439/352

(Continued)

*Primary Examiner* — Ross Gushi

(74) *Attorney, Agent, or Firm* — Gerald E. Hespos; Michael J. Porco; Matthew T. Hespos

(57) ABSTRACT

A lock arm (12) is cantilevered back from a front end part of a housing main body (11). The lock arm (12) includes an accommodating recess (31) that is open toward a deformation space (25) therefor and toward the back. When the housing main body (11) is connected properly to a mating housing (50) and a detector (70) is pushed from a standby position to a detection position, a part of the detector (70) is inserted into the accommodating recess (31).

11 Claims, 27 Drawing Sheets

(56) References Cited

U.S. PATENT DOCUMENTS

2010/0055972 A1 3/2010 Nakamura
2013/0237081 A1* 9/2013 Kon et al. ..... 439/350
2013/0237083 A1* 9/2013 Kon et al. ..... 439/354
2013/0237084 A1* 9/2013 Kon et al. ..... 439/354
2014/0134867 A1* 5/2014 Kon et al. ..... 439/345

* cited by examiner

CONNECTOR AND CONNECTOR ASSEMBLY

BACKGROUND OF THE INVENTION

1. Field of the Invention

The invention relates to a connector and to a connector assembly.

2. Description of the Related Art

U.S. Pat. No. 6,712,635 discloses a connector with a mating housing and a housing main body connectable to the mating housing. A lock arm is cantilevered back from a front part of the housing main body and is configured to engage a lock receiving portion of the mating housing to hold the housing main body and the mating housing in a connected state. A detector is mounted on the housing main body and is movable from an initial position to a detection position via a standby position. The detector configured to detect whether the mating housing has been connected properly to the housing main body based on whether the detector can be moved from the standby position to the detection position.

An engaging portion is formed on a rear part of the lock arm and a through hole penetrates through a front part of the lock arm in a height direction. A locking portion projects on a leading end part of the detector and is fit in the through hole of the lock arm when the detector reaches the detection position.

The through hole is formed to be open on the front end of the lock arm as a mold is pulled forward while molding the engaging portion. However, the front part of the lock arm defines a supporting point portion for resilient deformation. Thus, the through hole reduces a resilient force of the lock arm, and the lock arm is not reliably strong.

The invention was completed in view of the above situation and an object thereof is to improve locking reliability.

SUMMARY OF THE INVENTION

The invention relates to a connector with a housing main body to be connected to a mating housing. A resiliently deformable lock arm projects from the housing main body and a deformation space is formed between the lock arm and the housing main body to accommodate deformation of the lock arm in a deforming direction that intersects a connecting direction of the housing main body with the mating housing. The lock arm can resiliently engage a lock receiving portion of the mating housing to hold the housing main body connected to the mating housing. An accommodating recess is open toward the deformation space and toward the back. A detector is mounted to the housing main body and is movable from an initial position to a detection position via a standby position. The detector is configured such that (i) a movement in a movement direction is restricted at the initial position by contact of the detector with the lock arm along the movement direction before the housing main body is connected to the mating housing, (ii) a movement restricted state at the initial position is released and the detector is kept at the standby position to substantially face the accommodating recess along the movement direction when the housing main body is properly connected to the mating housing, and (iii) the detector reaches the detection position by a displacement operation in the movement direction from the standby position so that the detector is inserted into the accommodating recess.

Part of the detector is accommodated in the accommodating recess of the lock arm when the detector reaches the detection position. Thus, the lock arm and the detector overlap in the deforming direction (i.e. the height direction) and the corresponding height dimension of the connector can be reduced. The accommodating recess is open toward the deformation space for the lock arm and toward the back, but is not open on a front part connected to the housing main body. Thus, a reduction the lock arm is strong and locking reliability is good.

The lock arm preferably is cantilevered back from a front part of the housing main body.

The lock arm preferably is formed with a lock projection to be fit into the lock receiving portion at the time of proper connection.

The lock projection preferably projects in the deforming direction toward a side opposite to the deformation space on the lock arm, and the accommodating recess preferably is open on the rear surface of the lock projection.

A protrusion preferably projects from the detector in the deforming direction and can be inserted into the accommodating recess at the detection position. The protrusion preferably overlaps the lock projection in the deforming direction at the standby position.

An inclined guide surface preferably is formed on the front surface of the protrusion and faces an opening edge of the accommodating recess on the rear of the lock projection in forward and backward directions at the standby position. The inclined guide surface slides in contact with the opening edge of the accommodating recess in the process of reaching the detection position from the standby position, thereby guiding the protrusion into the accommodating recess.

An auxiliary protrusion may be formed on a part of a projecting end of the protrusion to project in the deforming direction. An auxiliary guide surface may be formed on the front surface of the auxiliary protrusion to be continuous with the guide surface. A part of the inner surface of the accommodating recess may be recessed to form an auxiliary recess into which the auxiliary protrusion is fit at the detection position.

An area of the front surface of the protrusion corresponding to the auxiliary protrusion in a width direction may be a steeply inclined surface inclined with respect to forward and backward directions and may be continuous and flush with the front surface of the auxiliary protrusion. An area of the front surface of the protrusion not corresponding to the auxiliary protrusion in the width direction preferably is moderately inclined and has a smaller angle of inclination with respect to forward and backward directions than the steeply inclined surface and preferably is receded more than the steeply inclined surface.

The moderately inclined surface preferably slides in contact with the opening edge of the accommodating recess in the process of moving the detector from the standby position to the detection position, thereby guiding the insertion of the protrusion into the accommodating recess.

The accommodating recess preferably is cut obliquely to form at least one escaping portion to avoid interference of the auxiliary protrusion with the lock projection while moving the detector from the standby position to the detection position.

The detecting member preferably is configured so that (i) the insertion movement is restricted at the initial position by the contact of a resilient arm of the detector with the lock arm before the housing main body is connected to the mating housing; (ii) the movement restricted state at the initial position is released and the detector can move to the detection position where the resilient arm enters the deformation space by being displaced from the initial position when the housing main body is connected properly to the mating housing; and (iii) the resilient arm is held in contact with the lock arm in the deforming direction at the initial position to apply a pre-load to the lock arm.

The invention also relates to a connector assembly comprising the above-described connector having a housing and a mating connector having a mating housing connectable with the housing. The mating housing has a lock receiving portion engageable with the lock arm to lock the housings in the connected state.

The moderately inclined surface may be formed by making the angle of inclination smaller to make the entire area of the front surface of the protrusion and that of the front surface of the auxiliary protrusion flat. However, if the moderately inclined surface is formed in this way, it means a reduction in the height of the upper end of the auxiliary protrusion. Thus, an overlap margin between the auxiliary protrusion and the lock projection in the height direction or the deforming direction is reduced and the height of the connector cannot be sufficiently reduced. However, in the present invention, the moderately inclined surface preferably is formed only in the area of the front surface of the protrusion not corresponding to the auxiliary protrusion in the width direction. Thus, even if the moderately inclined surface is formed, the height of the upper end of the auxiliary protrusion is unchanged and the overlap margin between the auxiliary protrusion and the lock projection in the height direction is not reduced. Therefore, there is no problem in reducing the height of the connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to an embodiment of the invention includes a housing 10 that is connectable to a mating housing 50 and a detector 70 to be mounted on the housing 10. In the following description, ends of each housing 10, 50 that is to be connected is referred to as the front concerning forward and backward directions FBD.

Figure 11:
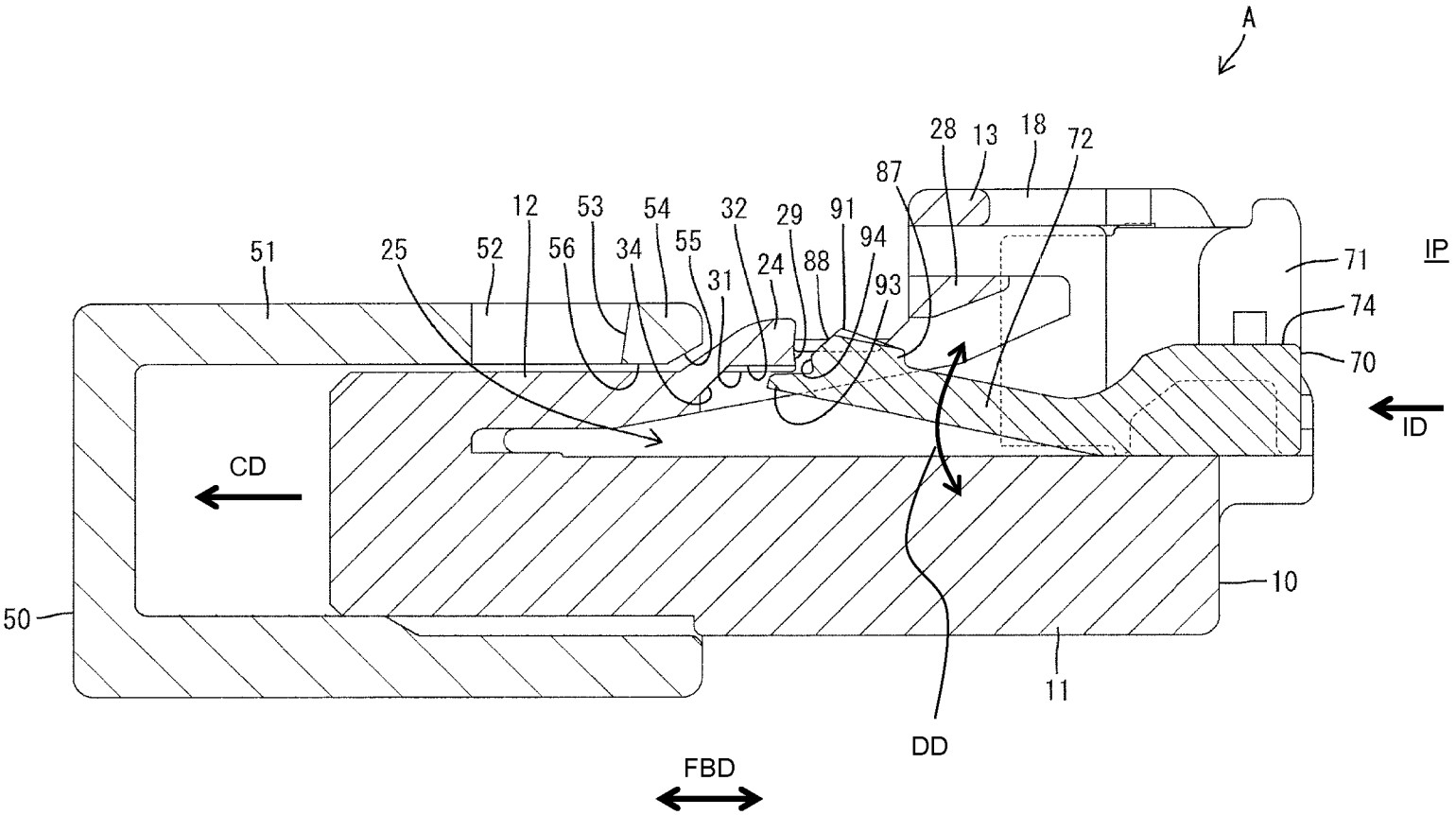
FIG. 11 is a section showing a state where the detecting member is mounted at the initial position and a housing main body is lightly connected to a mating housing.

The mating housing 50 is made e.g. of synthetic resin and has a substantially tubular receptacle 51 that opens forward, as shown in FIG. 11. A lock receiving portion 52 is formed on a front part of the upper wall of the receptacle 51. The lock receiving portion 52 penetrates through the upper wall of the receptacle 51 in a height direction HD, which intersects a connecting direction CD of the housings 10, 50. An engaging surface 53 is formed at the inner front of the lock receiving portion 52 and has a reverse taper inclined slightly forward toward an outer side. An interfering portion 54 is formed immediately before the lock receiving portion 52 at the front end of the upper wall of the receptacle 51. An inclined surface 55 is formed at a lower end of the front surface of the interfering portion 54 and inclines forward toward an outer side. A pressing surface 56 is defined on the lower side of the interfering portion 54 and extends substantially horizontally and parallel to the connecting direction CD from the inclined surface 55 to the lock receiving portion 52.

Figure 3:
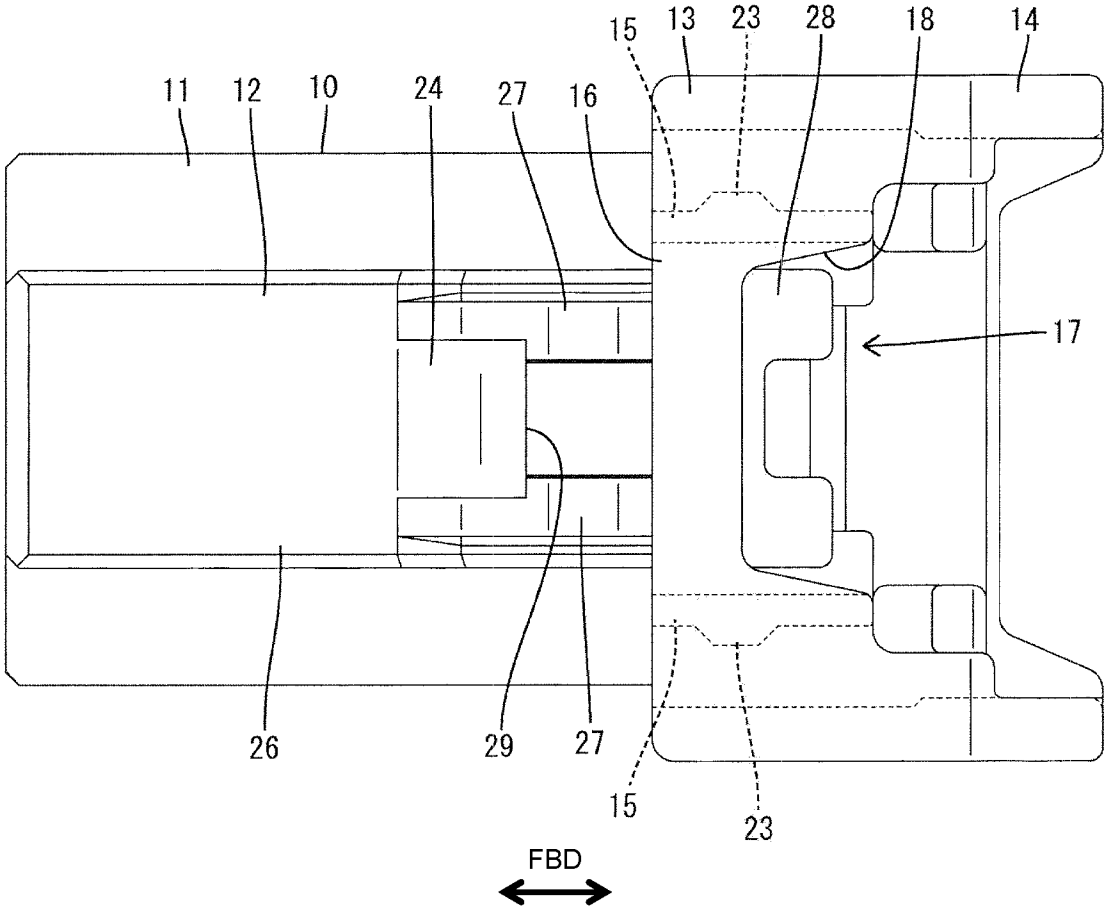
FIG. 3 is a plan view of the housing.
Figure 4:
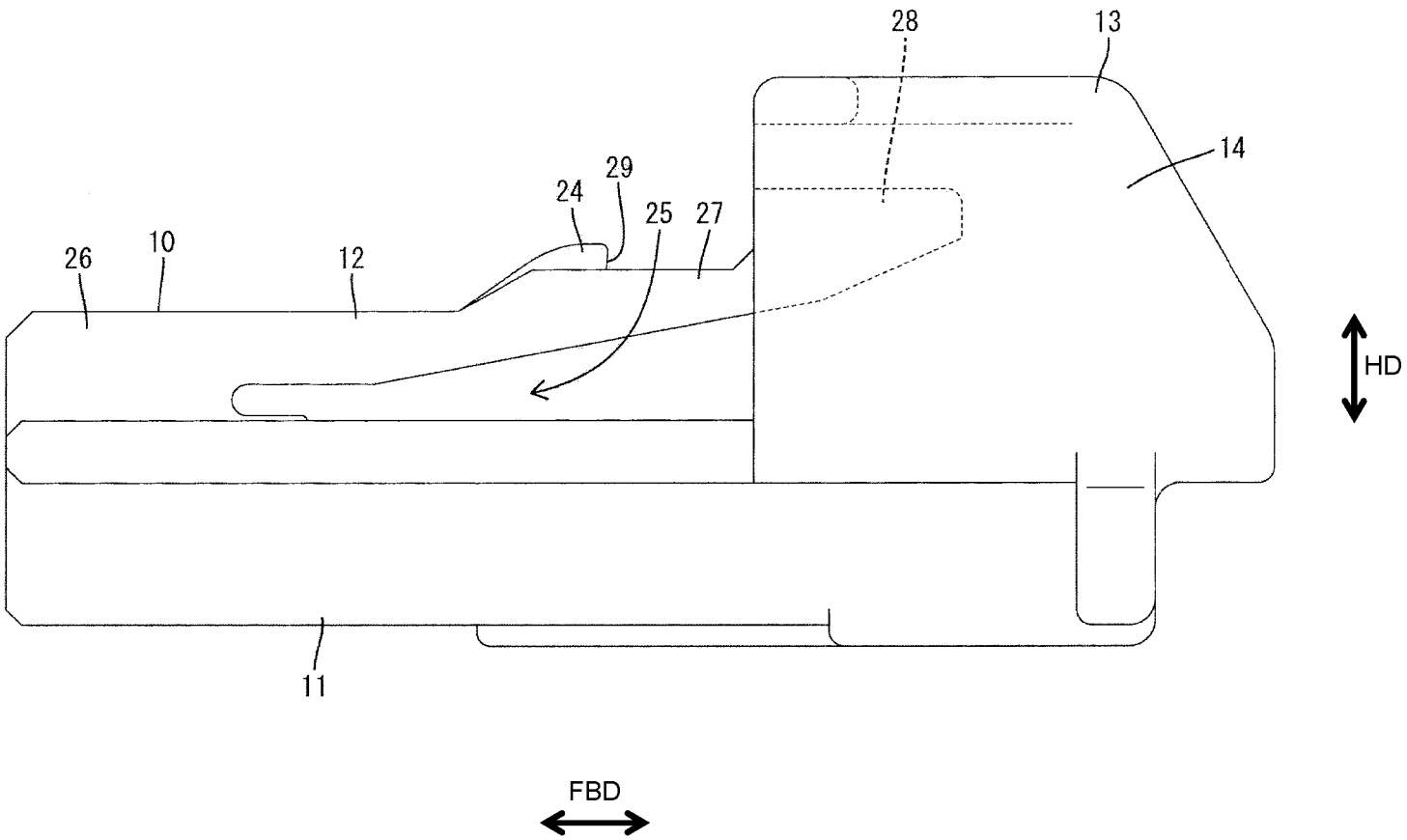
FIG. 4 is a side view of the housing.

The housing 10 is made e.g. of synthetic resin and includes a substantially block-shaped housing main body 11 and a resiliently deformable and lock arm 12 cantilevered unitarily from the upper surface of the housing main body 11, as shown in FIGS. 3 and 4. Unillustrated terminal fittings are inserted into the housing main body 11.

Figure 5:
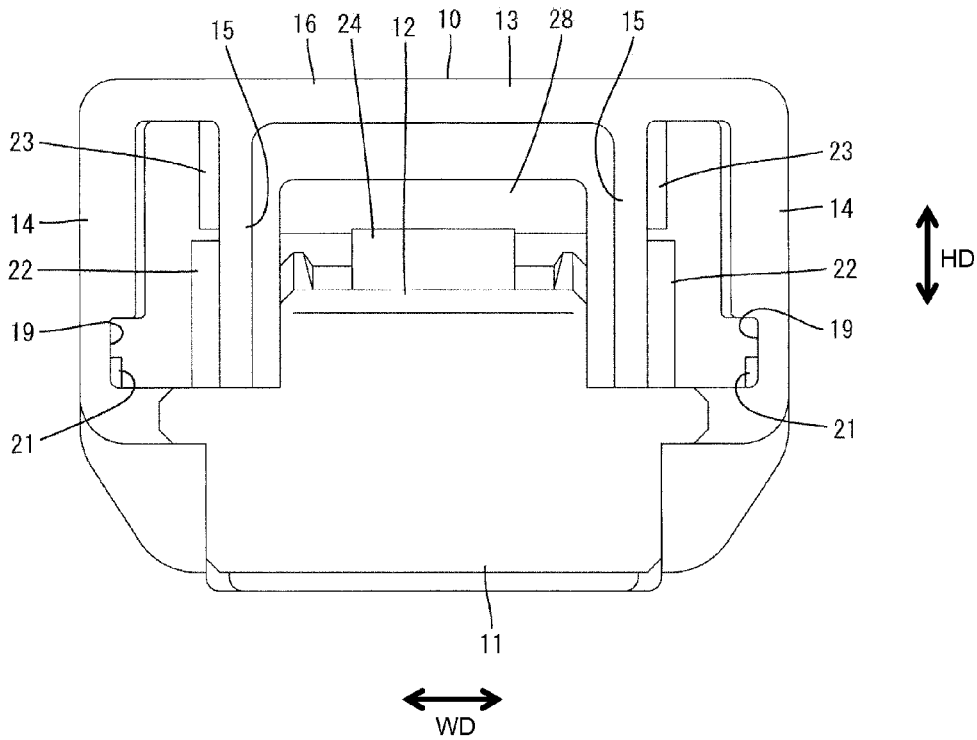
FIG. 5 is a front view of the housing.
Figure 6:
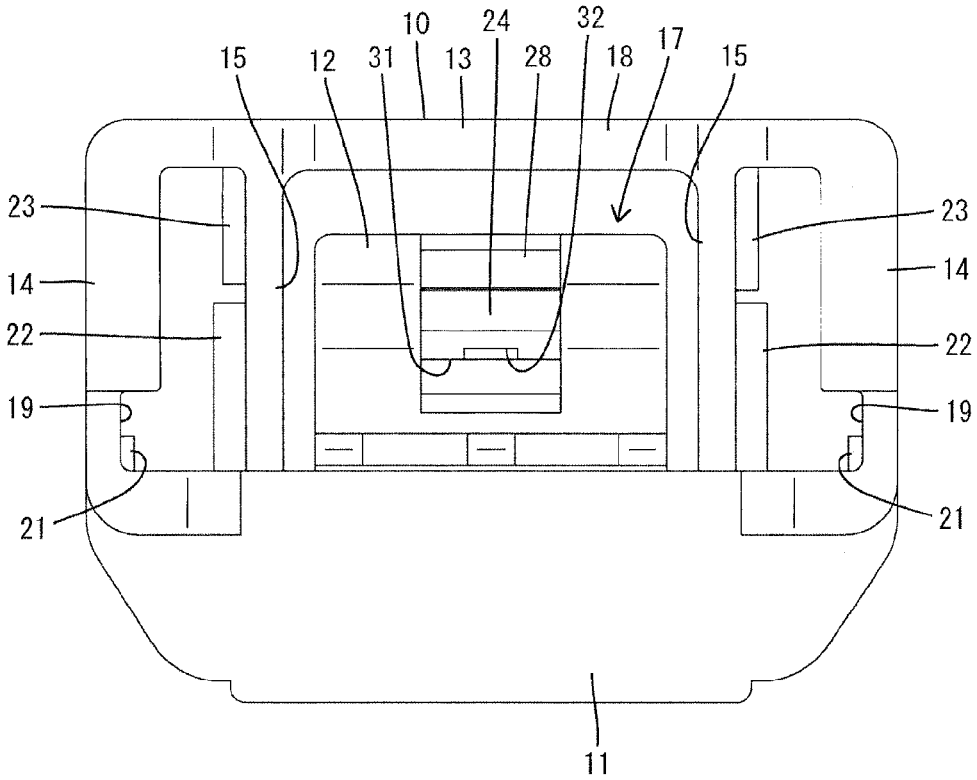
FIG. 6 is a rear view of the housing.

A substantially arch-shaped protection wall 13 is formed on the outer surface of a rear part of the housing main body 11 and surrounds a rear part of the lock arm 12, as shown in FIGS. 5 and 6. The protection wall 13 comprises two outer side walls 14, two inner side walls 15 and a covering wall 16. The outer side walls 14 project up from opposite widthwise end parts of the upper surface of the housing main body 11. The inner side walls 15 project up from the upper surface of the housing main body 11 at positions inward of the outer side walls 14. The covering wall 16 is connected to the upper ends of the inner side walls 15 and the outer side walls 14 and extends over substantially the entire width of the housing main body 11. A mount space 17 is defined inward of the protection wall 13, as shown in FIG. 19, and can receive the detector 70 inserted from behind in an insertion direction ID and parallel to the connecting direction CD.

A cut portion 18 is open on the rear end of the covering wall 16, as shown in FIG. 3, and the disengaging portion 28 of the lock arm 12 can be seen through the cut portion 18. Rear ends of the inner side walls 15 are partitioned by the cut portion 18 to be located before the rear ends of the outer side walls 14.

Figure 16:
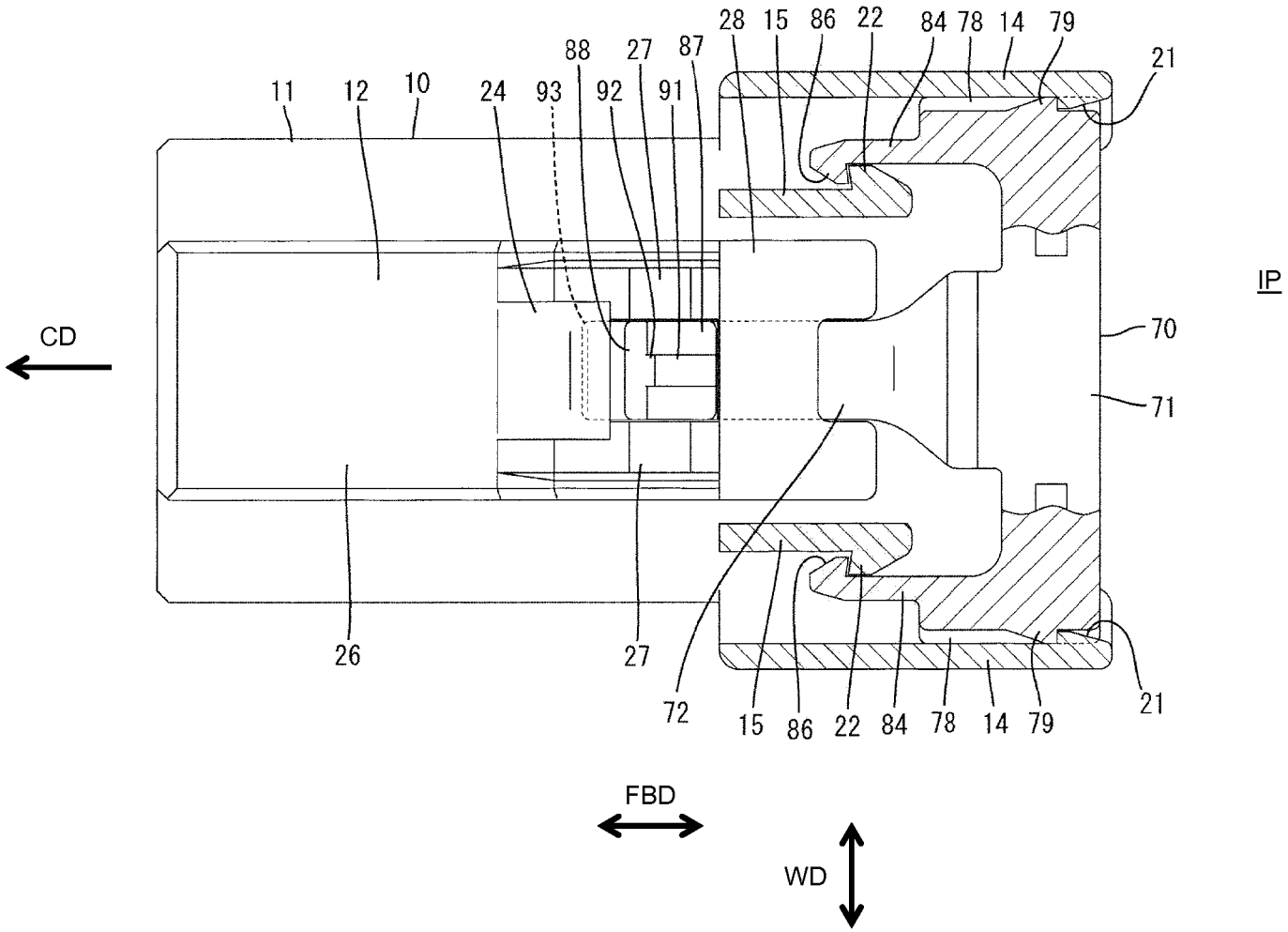
FIG. 16 is a section of an essential part showing a state where the detecting member is retained in the housing main body at the initial position.
Figure 19:
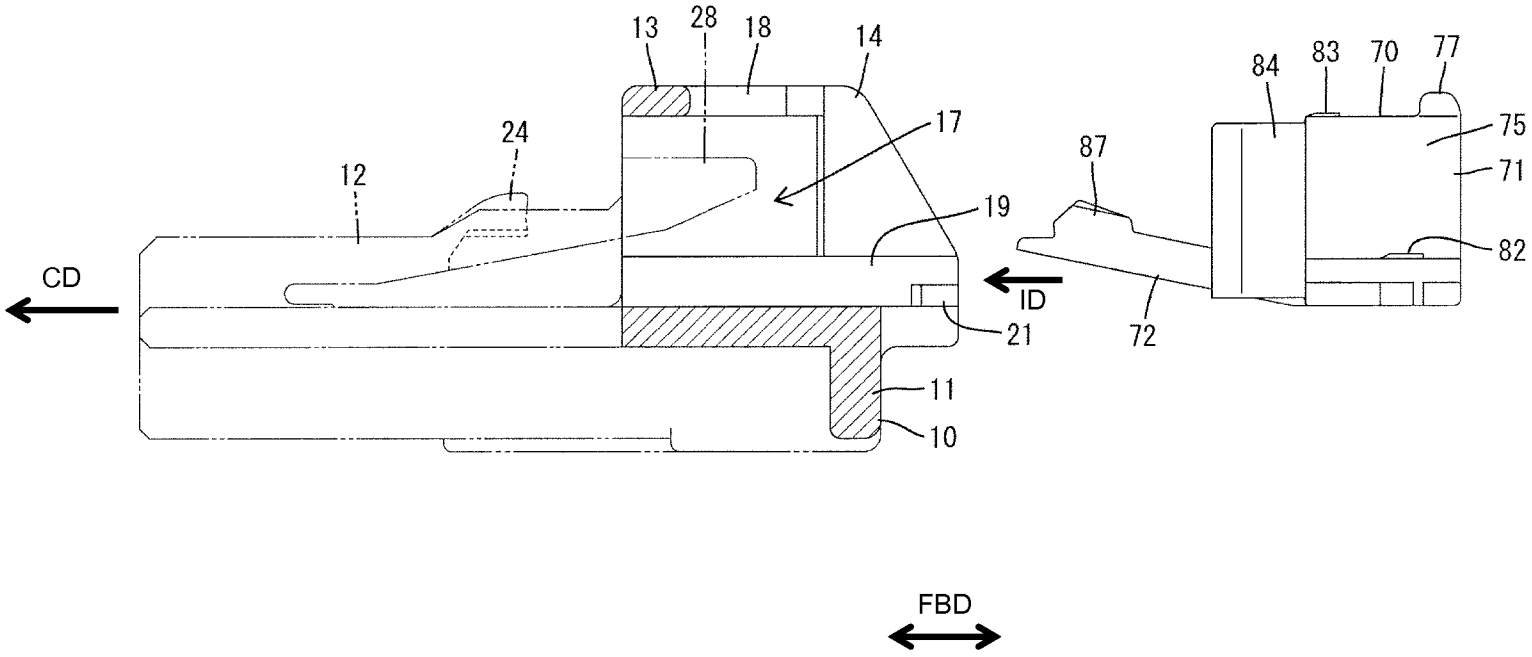
FIG. 19 is a side view with an essential part in section showing a state before the detecting member is mounted on the housing main body.

As shown in FIGS. 5 and 19, a guide groove 19 is formed on the inner surface of lower end part of each outer side walls 14. Each guide grooves 19 has a rectangular cross section, extends in forward and backward directions FBD and is open on both front and rear ends of the outer side walls 14. A first retaining portions 21 projects in on the inner surface of lower part of the rear end of each guide groove 19. As shown in FIG. 16, the rear surfaces of each first retaining portions 21 is tapered to incline in toward the front and the front surface thereof extends substantially in a width direction WD, which is perpendicular to the forward and backward directions FBD, the inserting direction ID and the connecting direction CD.

A second retaining portions 22 projects out on the outer surface of a rear end part of each inner side wall 15. As shown in FIGS. 5 and 6, each second retaining portion 22 is a long and narrow rib extending up or out in a height direction HD and substantially perpendicular to the forward and backward directions FBD and the width direction WD from the upper surface of the housing main body 11. As shown in FIG. 16, the rear surfaces of each second retaining portion 22 is tapered to incline out toward the front and the front surface thereof is reverse tapered to incline slightly forwardly toward an outer side.

Figure 17:
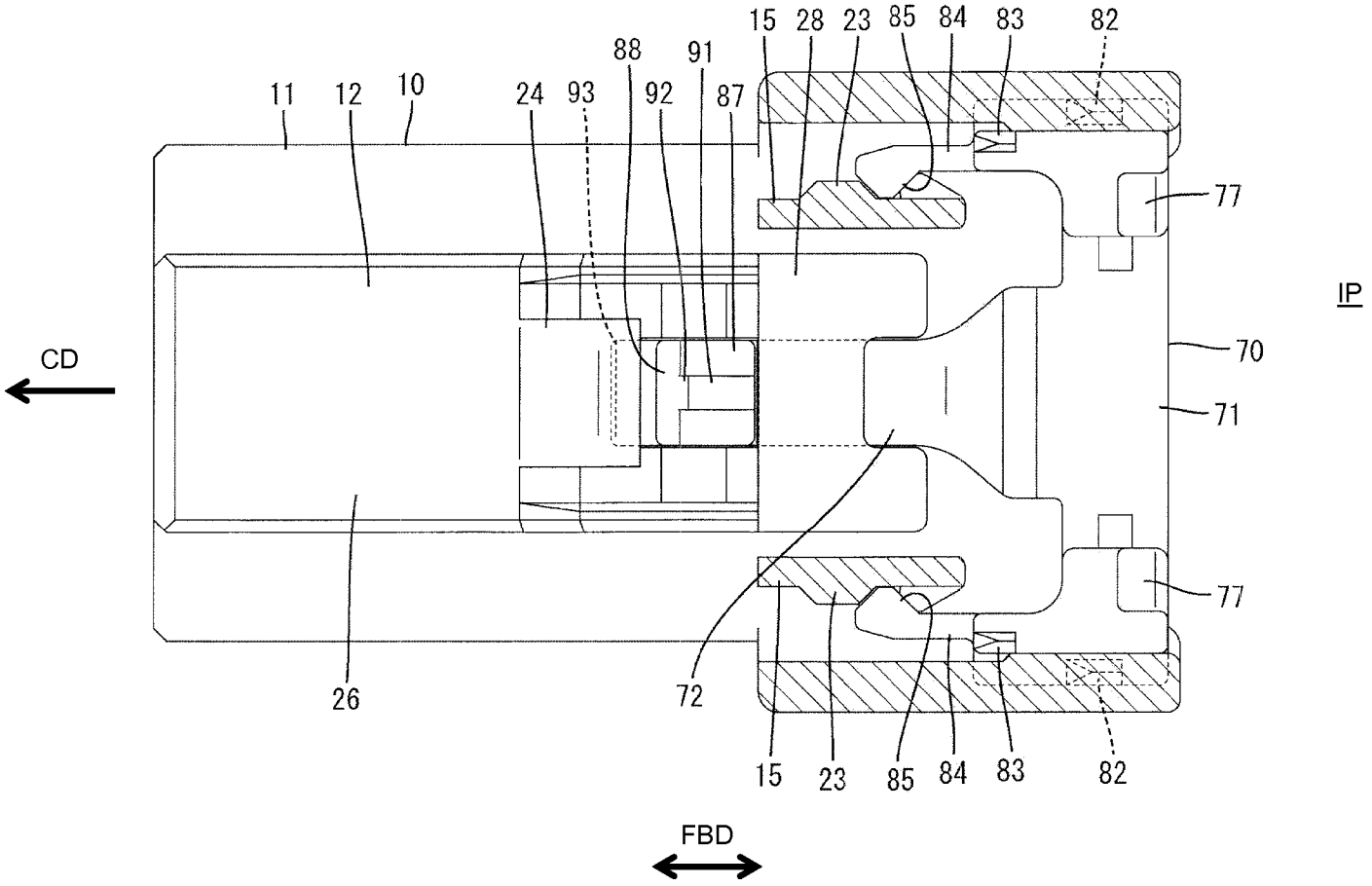
FIG. 17 is a section of an essential part showing a state where a movement of the detecting member to the detection position is prevented at the initial position.

A restricting portion 23 projects out on the outer surface of front end parts of each inner side walls 15, as shown in FIG. 17. Each restricting portion 23 is a long and narrow rib extending down in the height direction HD from the lower surface of the covering wall 16, as shown in FIGS. 5 and 6. Each restricting portion 23 has a shorter projecting distance than the second retaining portions 22, has a longer extending length than the second retaining portions 22 and is arranged above the second retaining portions 22. As shown in FIG. 17, the rear surface of each restricting portion 23 is tapered to incline out toward the front and the front surface thereof is tapered to incline in toward the front.

As shown in FIG. 4, the lock arm 12 extends back along the connecting direction CD from the upper or outer surface of a front end part of the housing main body 11. A lock projection 24 projects in the height direction HD at an intermediate part of the lock arm 12 in forward and backward directions FBD. A deformation space 25 is formed between the lower surface of the lock arm 12 and the upper surface of the housing main body 11.

As shown in FIG. 3, the lock arm 12 has a rectangular plate-shaped base end portion 26 before the lock projection 24. The front of the base end 26 is coupled to the upper surface of the housing main body 11, as shown in FIG. 4, and defines a support for resilient deformation of the lock arm 12. Two coupling beams 27 extend back from sides of the lock projection 24 and a disengaging portion 28 extends in the width direction WD and at a slightly higher position to join rear ends of the coupling beams 27, as shown in FIGS. 3 and 4. The lock projection 24 has a rearwardly facing locking surface 29, a reversely tapered upper side facing the engaging surface 53 of the lock receiving portion 52 and a slightly tapered lower side facing a movement restricting surface 94 (to be described later) of the detecting member 70, as shown in FIG. 11.

Figure 13:
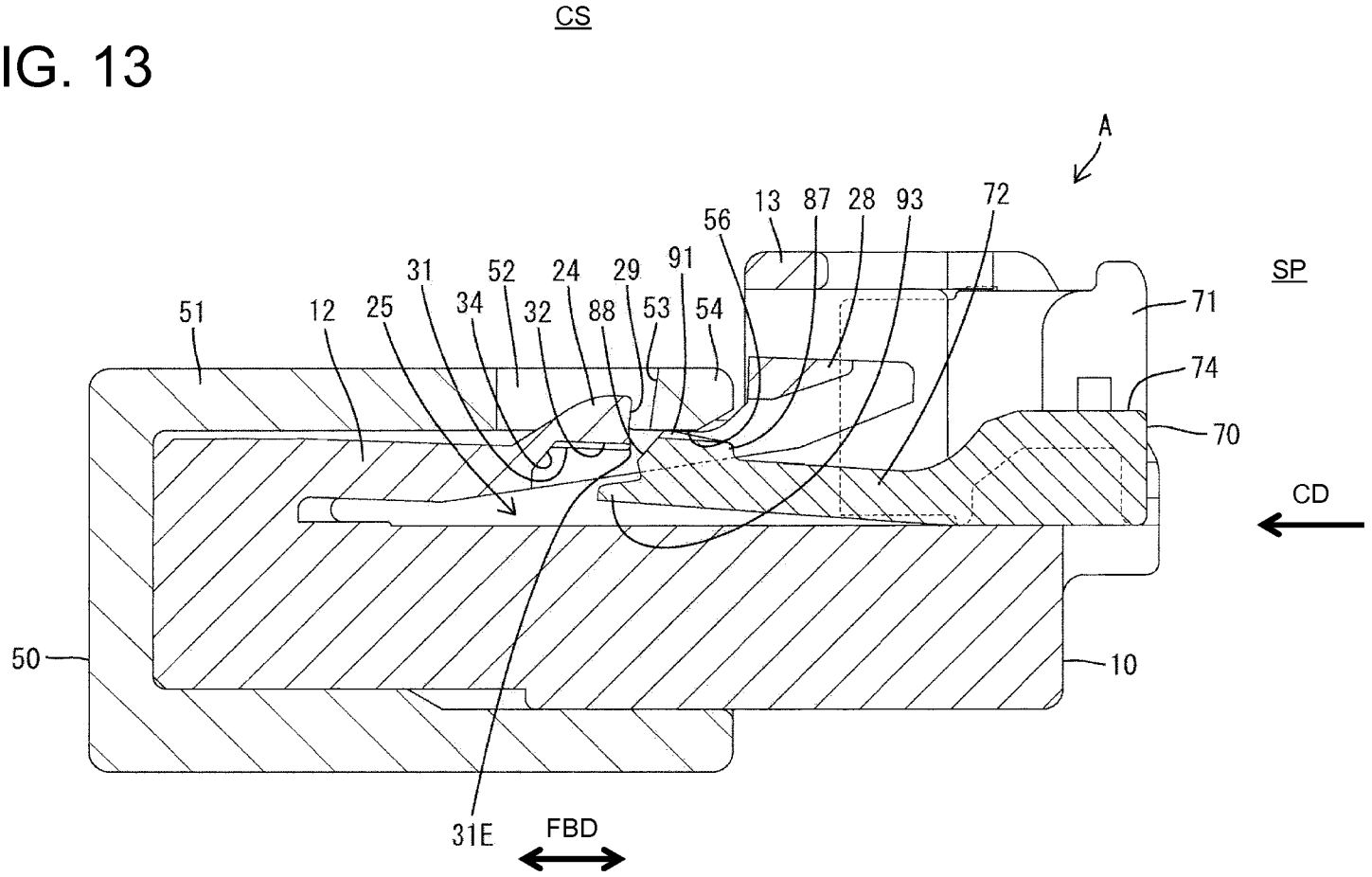
FIG. 13 is a section showing a state where the housing main body is properly connected to the mating housing, the lock arm is engaged with a lock receiving portion and the detecting member is kept at a standby position.

The lock projection 24 is urged resiliently into the lock receiving portion 52 from below when the two housings 10, 50 are connected properly, as shown in FIG. 13, so that the locking surface 29 can contact the engaging surface 53 to hold the two housings 10, 50 in a connected state CS. On the other hand, the disengaging portion 28 can be pressed from above when the two housings 10, 50 are connected properly to deform the lock arm 12 resiliently into the deformation space 25. In this way, the lock projection 24 exits the lock receiving portion 52 and the two housings 10, 50 can be separated or pulled apart.

A rearwardly open accommodating recess 31 is formed below the lock arm 12 and faces toward the deformation space 25, as shown in FIG. 11. The accommodating recess 31 is dimensioned and shaped to receive the protrusion 87 of the detector 70. The upper surface of the accommodating recess 31 is higher than the upper surface of the base end 26 of the lock arm 12. Further, an auxiliary recess 32 is formed in the upper part of the accommodating recess 31. As shown in FIG. 6, the auxiliary recess 32 is in a widthwise central part of the upper surface of the accommodating recess 31 and is less than half (particularly about ⅓) as wide as the accommodating recess 31. A depth of the auxiliary recess 32 is smaller than the depth of the accommodating recess 31.

Figure 7:
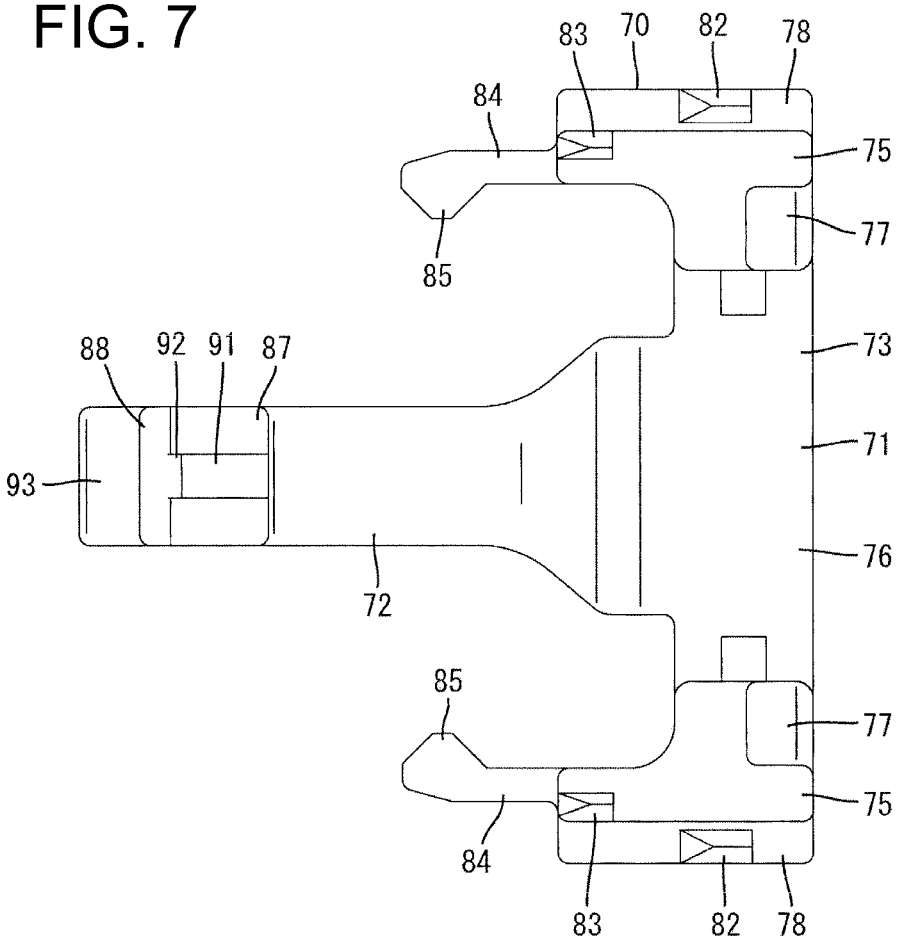
FIG. 7 is a plan view of the detecting member.
Figure 8:
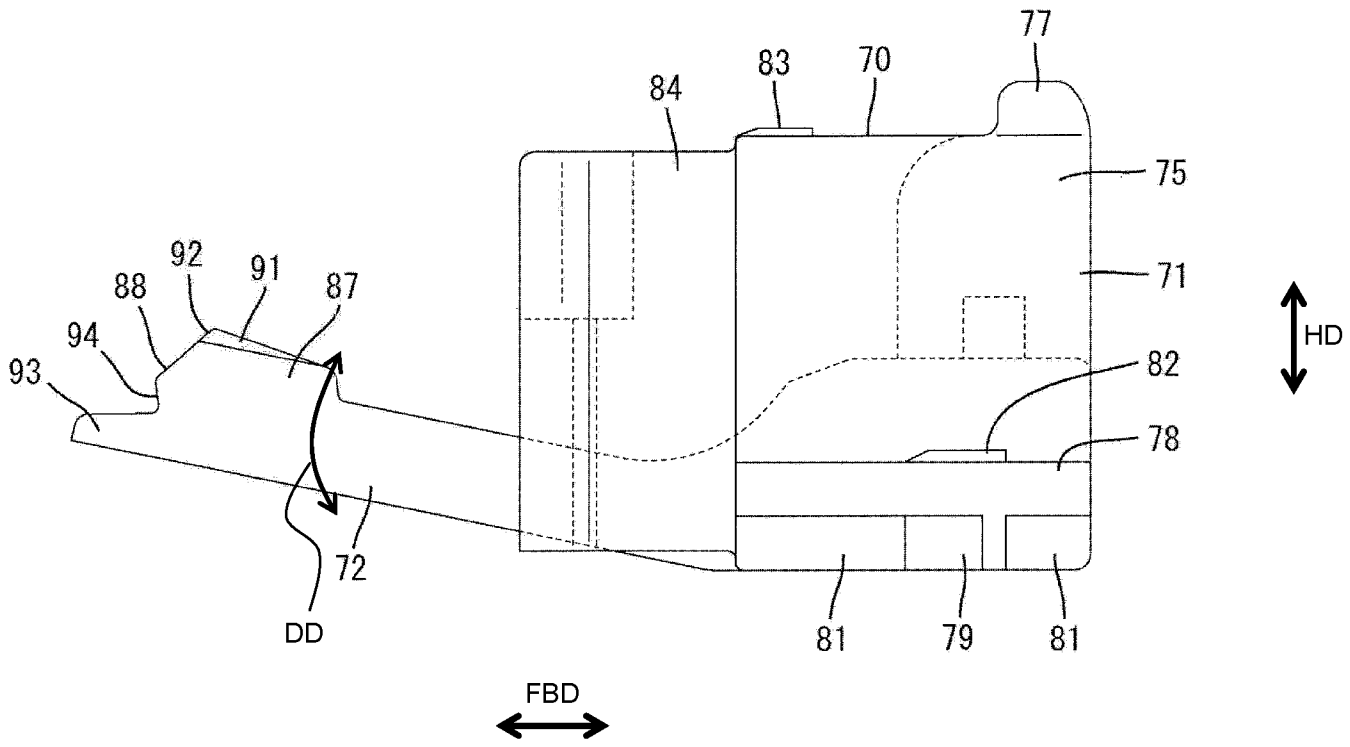
FIG. 8 is a side view of the detecting member.

The detector 70 is made e.g. of synthetic resin and includes a main portion 71 and a resilient arm 72 unitary with the front end of the main portion 71, as shown in FIGS. 7 and 8. The detector 70 is mounted in the housing main body 11 for movement from an initial position to IP a detection position DP via a standby position SP.

Figure 2:
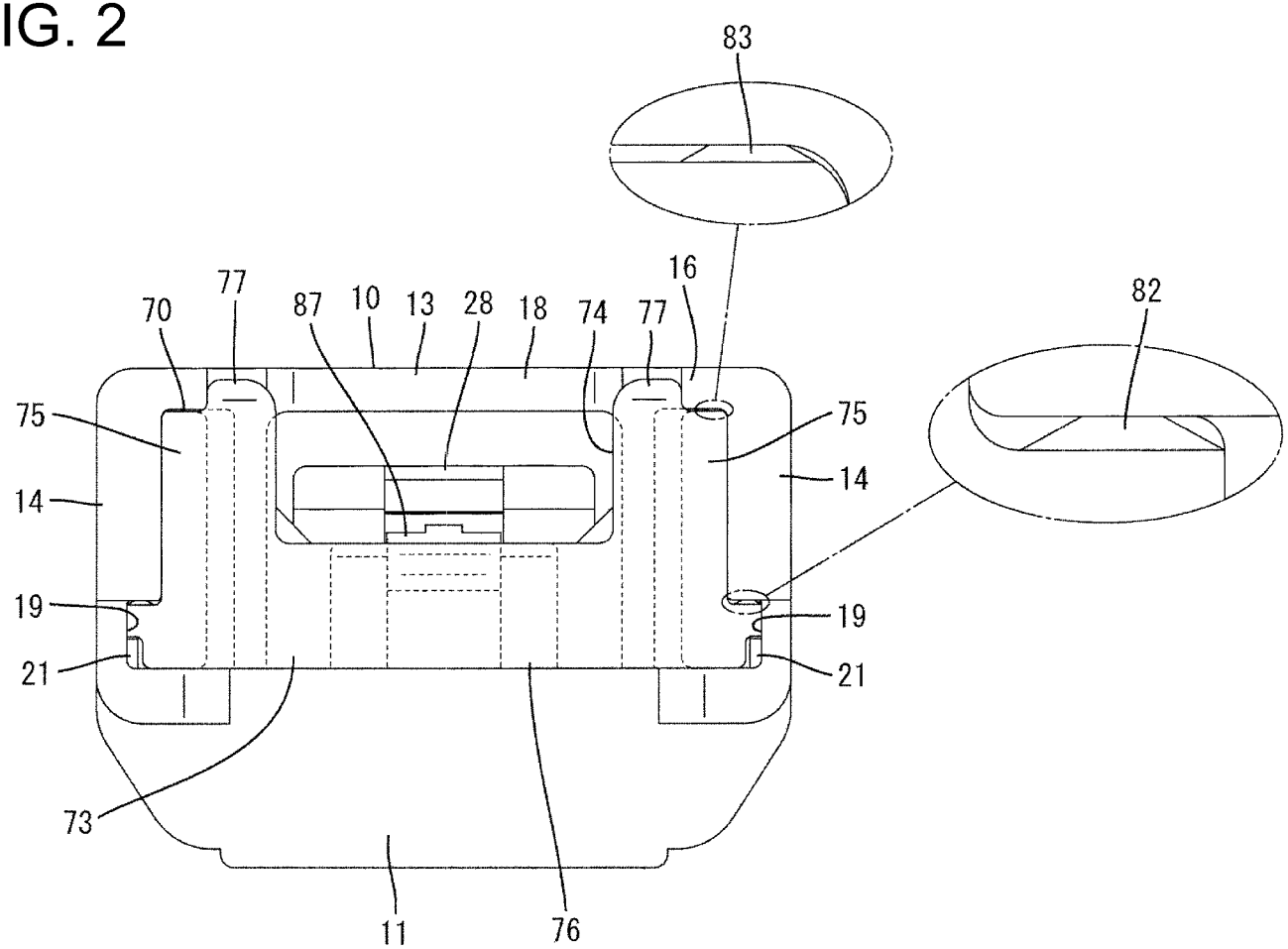
FIG. 2 is a rear view of the housing on which the detecting member is mounted at the initial position.
Figure 9:
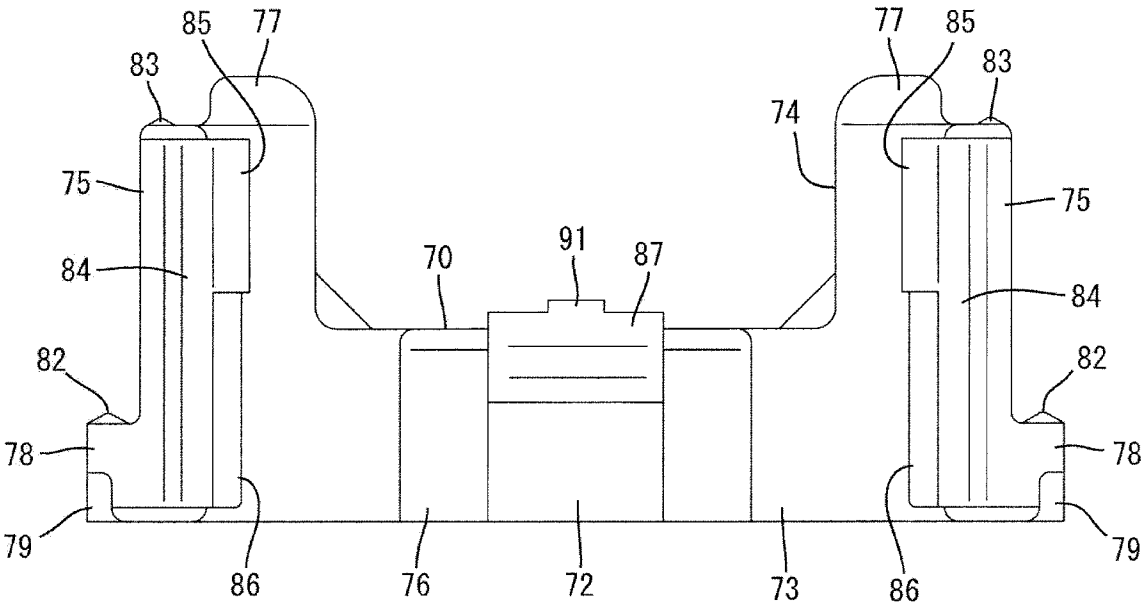
FIG. 9 is a front view of the detecting member.

The main portion 71 has a rear panel 73 extending substantially in the width direction WD and the height direction HD, as shown in FIGS. 2 and 9. The rear panel 73 is formed with a disengagement window 74 that defines a substantially U-shaped recess in a substantially widthwise central part of the upper end edge of the rear panel 73. The disengaging portion 28 of the lock arm 12 can be seen through the disengagement window 74 when the detector 70 mounted on the housing main body 11 is viewed from behind.

Two vertical walls 75 extend in the height direction HD at opposite widthwise ends of the rear panel 73 and a lateral wall 76 extends in the width direction WD to couple rear end parts of the vertical walls 75. The disengagement window 74 is partitioned by the vertical walls 75 and the lateral wall 76. The rear surfaces of the vertical walls 75 and the lateral wall 76 are arranged substantially along the height direction HD and can be pressed from behind during a movement to the detection position DP. A catch 77 projects on the upper end of each vertical wall 75. The catches 77 can be caught by fingers or a jig and a backward pulling force on the catches 77 can pull the detector 70 back from the detection position DP to the initial position IP.

Figure 10:
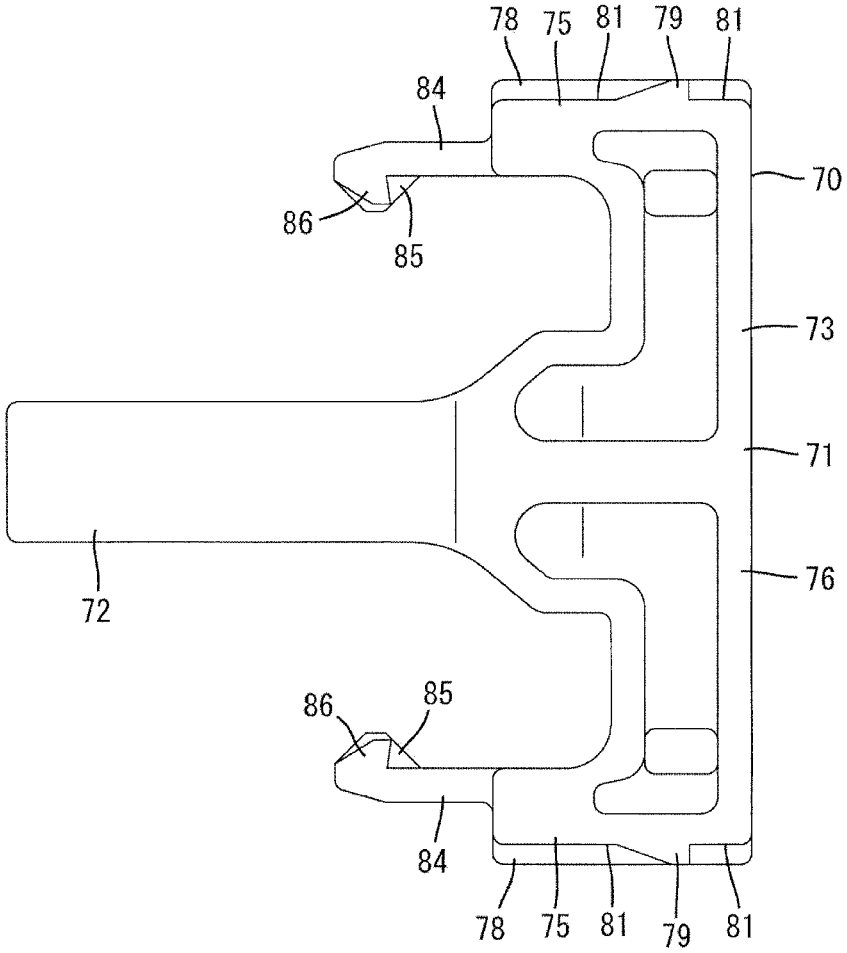
FIG. 10 is a bottom view of the detecting member.

Each vertical wall 75 is substantially rectangular in side view, as shown in FIG. 8. A guide rib 78 is formed on a lower part of the outer surface of the vertical wall 75 and extends in forward and backward directions FBD over substantially the entire length of the vertical wall 75. As shown in FIG. 10, a first stop 79 is formed on a lower part of each guide rib 78. The rear surface of each first stop 79 extends in the width direction WD. Each guide rib 78 has grooves 81 at front and rear sides of the first stop 79. The grooves 81 extend in forward and backward directions FBD and are open on both front and rear ends.

As shown in FIGS. 8 and 9, a first shake preventing projection 82 is formed on the upper surface of a rear part of each guide ribs 78 at a position to overlap the first stops 79 in forward and backward directions FBD. The first shake preventing projections 82 extend in forward and backward directions FBD at lower rear parts of opposite widthwise sides of the main portion 71 and have substantially triangular or pointed cross sections.

A second shake preventing projection 83 is formed on the upper end surface of a front part of each vertical wall 75. Each second shake preventing projection 83 is slightly smaller than the first shake preventing projection 82 and defines a rib of triangular or pointed cross section extending in forward and backward directions FBD. The second shake preventing projections 83 are adjacent upper front ends of the opposite widthwise sides of the main portion 71. In the moving process of the detector 70, the first shake preventing projections 82 are held in sliding contact with the upper surfaces of the guide grooves 19 while being squeezed and the second shake preventing projections 83 are held in sliding contact with the lower surface of the covering wall 16 while being squeezed, thereby ensuring a proper moving posture of the detector 70.

A resilient piece 84 projects forward on the front end of the vertical wall 75, as shown in FIG. 7. Each resilient piece 84 is a rectangular plate, as shown in FIG. 8, and is resiliently deformable in the width direction WD with the front end of the vertical wall 75 as a support. As shown in FIG. 9, a partial lock 85 and a second stop 86 are formed substantially side by side in the height direction HD on a front end part each resilient piece 84.

Figure 18:
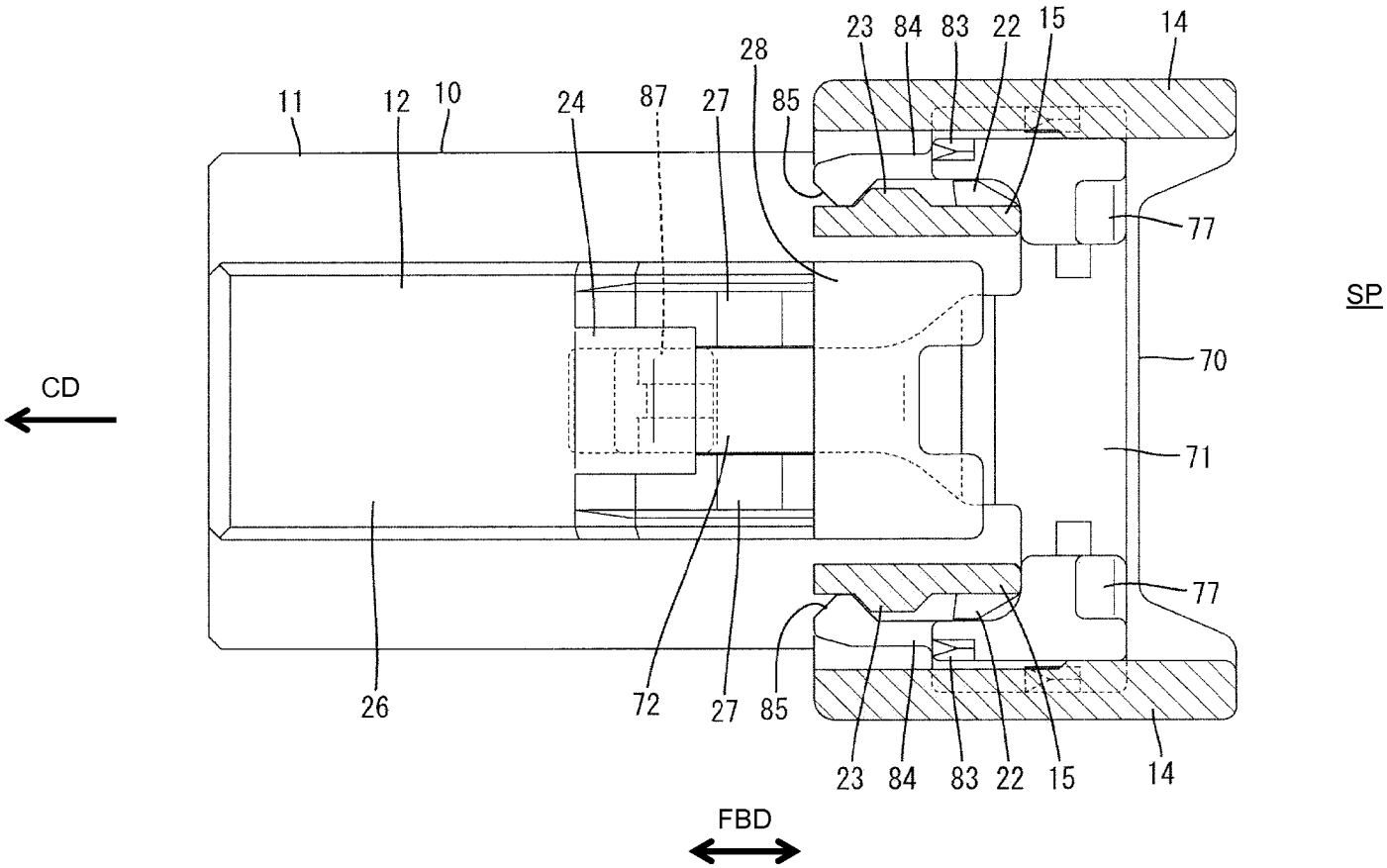
FIG. 18 is a section of an essential part showing a state where a return movement of the detecting member to the initial position is prevented at the standby position.

The partial locks 85 project in from upper halves of front parts of the resilient pieces 84 and extend in the height direction HD. As shown in FIG. 7, the rear surfaces of the partial locks 85 are tapered to incline in toward the front, and the front surfaces are tapered to incline out toward the front. As shown in FIG. 17, when the detector 70 is at the initial position IP, the front surfaces of the partial locks 85 are held in contact with the restricting portions 23 from behind in a semi-locking state to prevent movement of the detector 70 to the detection position DP. Further, as shown in FIG. 18, when the detector 70 is at the detection position DP, the rear surfaces of the partial locks 85 are in contact with the restricting portions 23 from the front in a semi-locking state to prevent a movement of the detector 70 to the initial position IP.

As shown in FIG. 9, the second stops 86 project in from lower front parts of the resilient pieces 84 and extend in the height direction HD. As shown in FIG. 10, the second stops 86 are slightly smaller than the partial locks 85. The rear surfaces of the second stops 86 are reverse tapered to incline slightly back toward an inner side. As shown in FIG. 16, when the detector 70 is at the initial position IP, the rear surfaces of the first stops 79 contact the first retaining portions 21 from the front and the rear surfaces of the second stops 86 contact the second retaining portions 22 from the front to prevent the detector 70 from being detached from or displaced within the housing main body 11.

Figure 12:
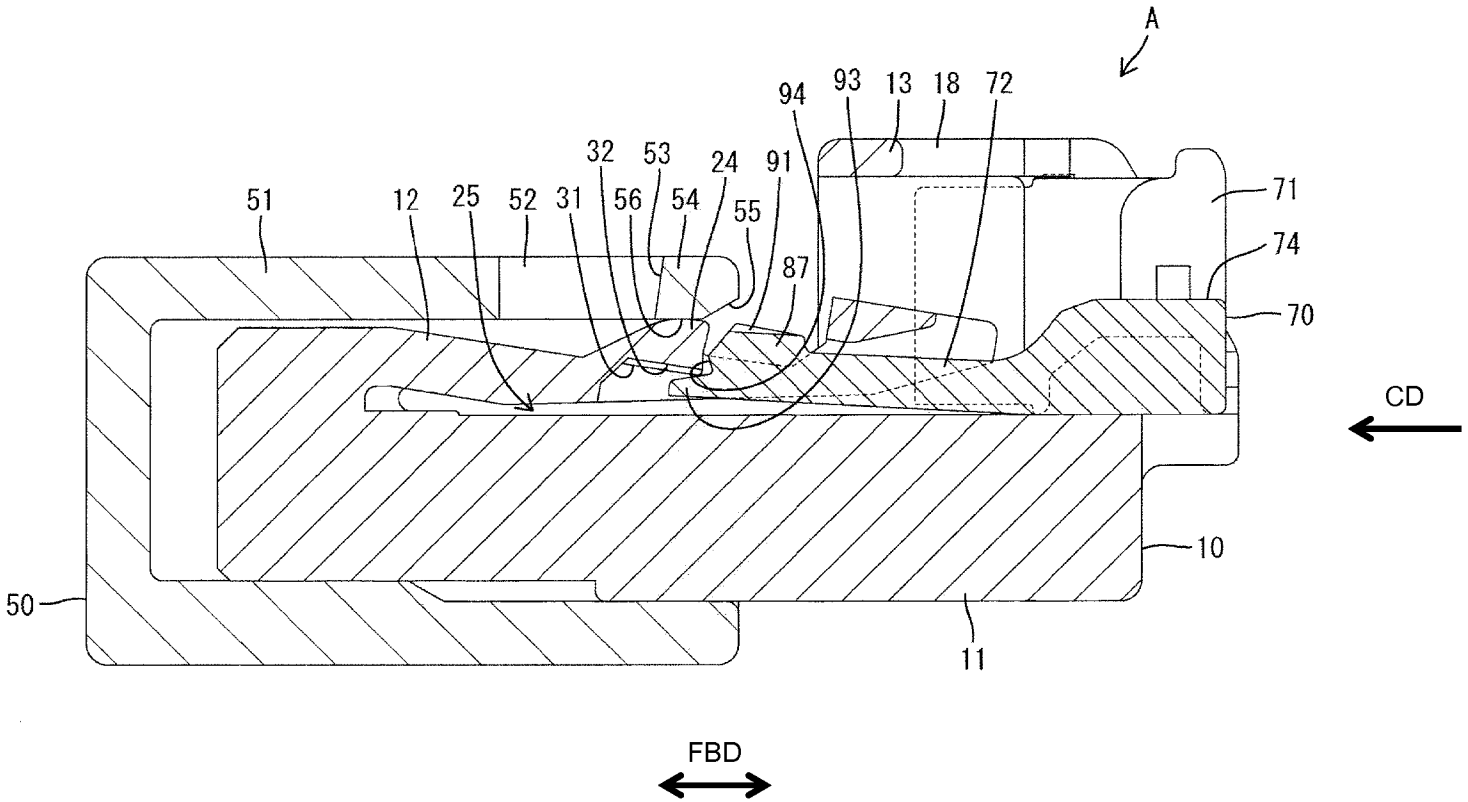
FIG. 12 is a section showing a state where the housing main body is further connected and a lock projection is pressed by a pressing surface of an interfering portion to resiliently deform a lock arm to a large extent.
Figure 15:
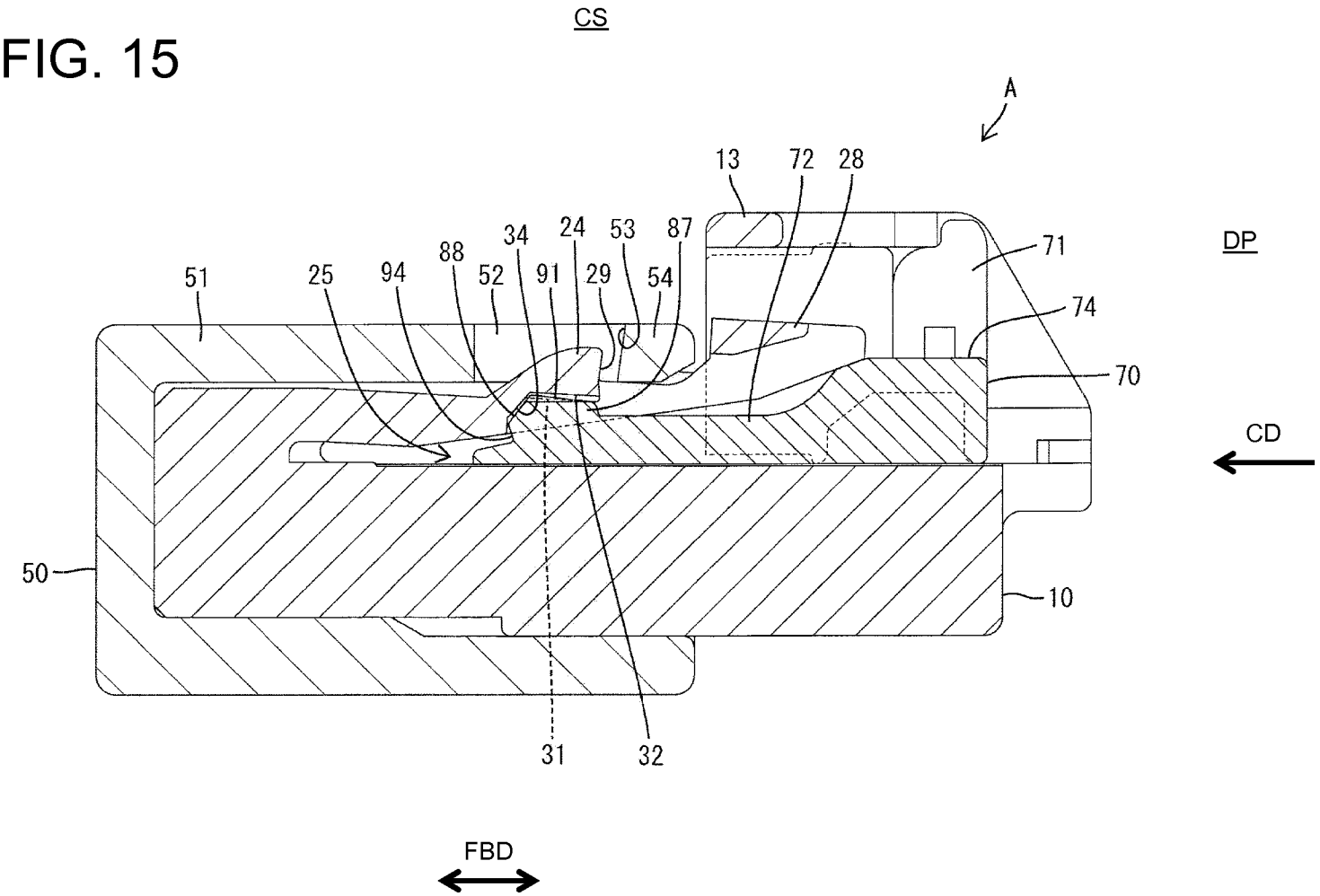
FIG. 15 is a section showing a state where the detecting member is located at the detection position and a protrusion is accommodated in the accommodating recess.

As shown in FIG. 8, the resilient arm 72 is cantilevered forward from a widthwise central part of the front of the main portion 71. The resilient arm 72 is a substantially rectangular bar and is resiliently deformable in a deforming direction DD (e.g. the height direction HD) with a rear end joined to and supported by the front of the main portion 71. The unbiased resilient arm 72 inclines up at a substantially constant angle of inclination from the rear to the front. On the other hand, as shown in FIGS. 11 to 13, the resilient arm 72 can be deformed resiliently along the deforming direction DD to gradually make its angle of inclination smaller as the detector 70 is displaced from the initial position IP to the standby position SP. The resilient arm 72 is substantially horizontal when the detector 70 reaches the detection position DP, as shown in FIG. 15. Thus, the resilient arm 72 accumulates a resilient force at the standby position SP and the detection position DP.

Figure 14:
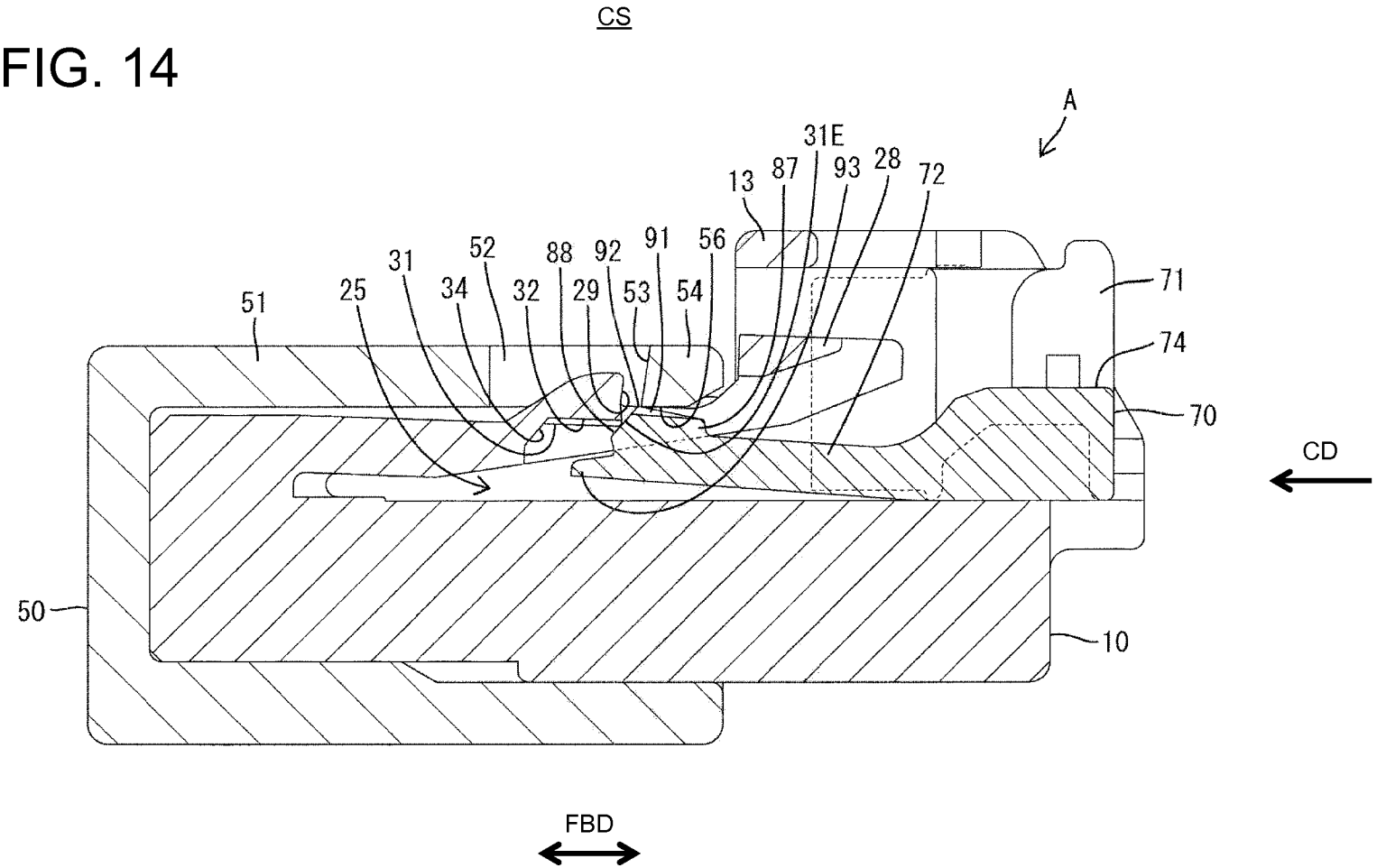
FIG. 14 is a section showing a state where a guide surface of the lock projection is held in sliding contact with an upper end opening edge of an accommodating recess in the process of moving the detecting member toward a detection position.

The protrusion 87 is a substantially rectangular block that projects up from a position near a front end of the resilient arm 72, as shown in FIG. 8. A tapered guide surface 88 is formed on an upper front part of the protrusion 87 and inclines up toward the back. The guide surface 88 of the protrusion 87 faces an upper opening edge of the accommodating recess 31 on the rear of the lock projection 24 when the detector 70 is at the standby position SP, as shown in FIG. 13. The guide surface 88 of the protrusion 87 slides on the upper opening edge of the accommodating recess as the detector 70 is moved from the standby position SP to the detection position DP, as shown in FIG. 14, and, accordingly, the resilient arm 72 inclines. The protrusion 87 then enters the accommodating recess 31 when the detector 70 reaches the detection position DP, as shown in FIG. 15. A tapered guided surface 34 is formed on the inner surface of the accommodating recess 31 and faces the guide surface 88 of the protrusion 87 at the detection position DP.

An auxiliary protrusion 91 projects on a widthwise central part of the upper surface of the protrusion 87 and forms a rib that extends in forward and backward directions FBD, as shown in FIGS. 8 and 9. A projecting distance of the auxiliary protrusion 91 is smaller than that of the protrusion 87. The auxiliary protrusion 91 fits into the auxiliary recess 32 when the protrusion 87 is inserted into the accommodating recess 31.

A tapered auxiliary guide surface 92 is formed at the front of the auxiliary protrusion 91 and inclines up and toward the back. The auxiliary guide surface 92 is substantially flush and continuous with the guide surface 88 and has substantially the same angle of inclination as the guide surface 88. The auxiliary guide surface 92 slides in contact with the upper opening edge of the accommodating recess 31, following the guide surface 88, as the detector 70 moves from the standby position SP to the detection position DP. Thus, the amount of resilient deformation of the resilient arm 72 is increased by the auxiliary protrusion 91. Note that an area of the upper surface of the auxiliary protrusion 91 behind the auxiliary guide surface 92 is tapered to incline down toward the back.

A contact portion 93 projects forward on a lower end part of the front end of the protrusion 87. As shown in FIG. 7, the contact portion 93 has a substantially rectangular plan view. The upper surface of the contact portion 93 is substantially horizontal and contacts the inner upper surface of the accommodating recess 31 from below when the detector 70 is at the initial position IP. In this way, the resilient arm 72 resiliently deforms slightly with a pre-load applied to the lock arm 12.

As shown in FIG. 8, a movement restricting surface 94 is formed between the guide surface 88 and the contact portion 93 on the front of the protrusion 87. The movement restricting surface 94 extends substantially in the height direction HD when the resilient arm 72 is in a natural state. Further, as shown in FIG. 11, the movement restricting surface 94 of the protrusion 87 faces the locking surface 29 of the lock projection 24 from behind when the detector 70 is at the initial position IP.

The detector 70 is inserted into the mount space 17 of the housing main body 11 from behind and along the inserting direction ID. The first shake preventing portions 82 slide in contact with the inner upper surfaces of the guide grooves 19 while being squeezed and the second shake preventing portions 83 slide in contact with the lower surface of the covering wall 16 while being squeezed, thereby ensuring a stable mounting posture of the detector 70 during the mounting process.

Figure 1:
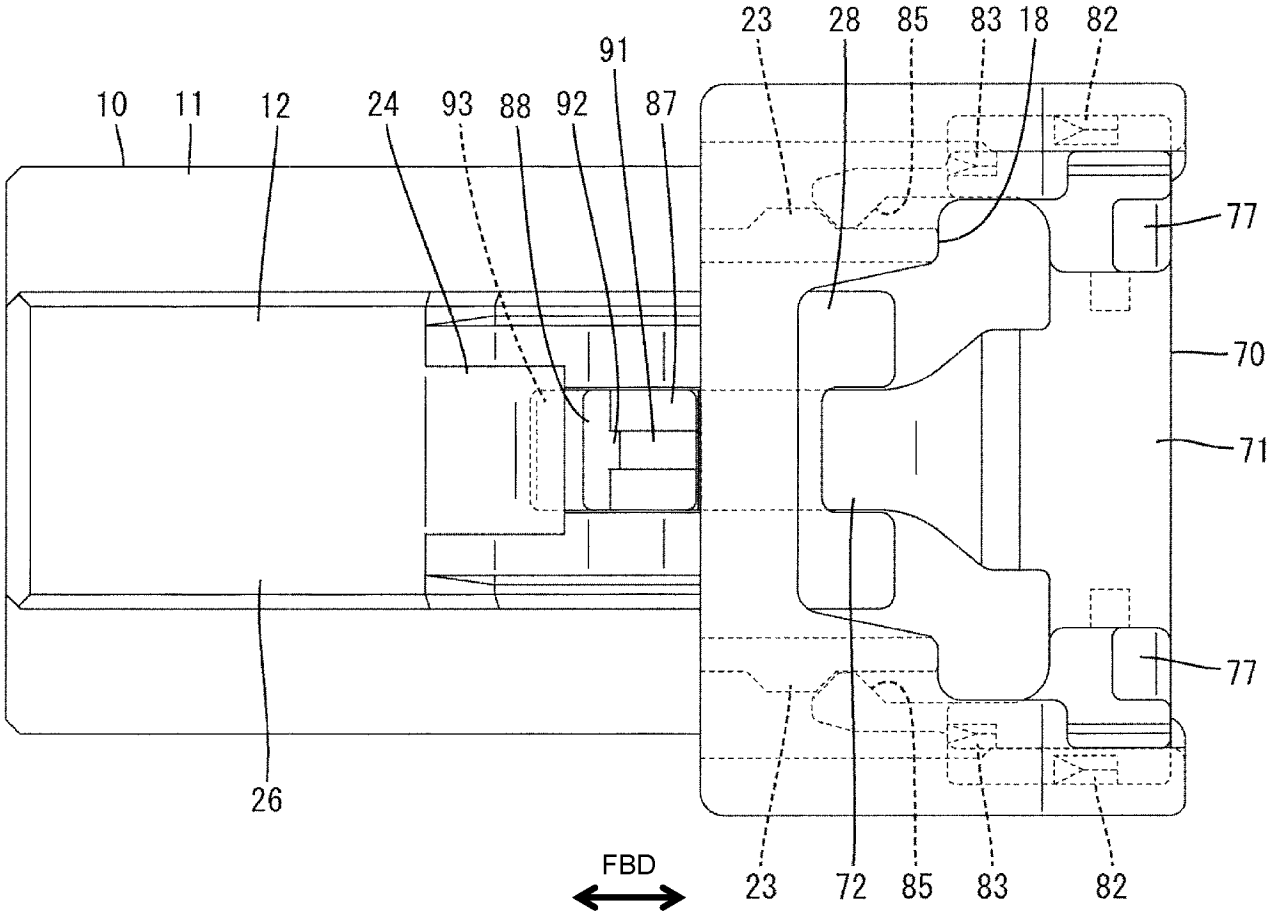
FIG. 1 is a plan view of a housing, on which a detecting member is mounted at an initial position, in a connector according to one embodiment of the present invention.

The resilient pieces 84 deform in the mounting process, but resiliently restore when the detector 70 reaches the initial position IP so that the second stops 86 engage the second retaining portions 22 from the front, as shown in FIG. 16. Simultaneously, the first stops 79 engage the first retaining portions 21 from front. Thus, the detector 70 cannot be detached backward from the housing main body 11. Further, the movement restricting surface 94 of the protrusion 87 engages the locking surface 29 of the lock projection 24 from behind when the detector 70 reaches the initial position IP, as shown in FIG. 11. The contact of the movement restricting surface 94 with the locking surface 29 prevents forward movement of the detector 70 along the inserting direction ID from the initial position IP. The contact of the partial locking portions 85 with the restricting portions 23 from behind, as shown in FIG. 17, further prevents forward movement of the detector 70 at the initial position IP. In this way, as shown in FIG. 1, the detector 70 is held in the housing main body 11 at the initial position IP with forward and backward movements prevented.

The contact portion 93 of the resilient arm 72 contacts the inner upper surface of the accommodating recess 31 at the initial position IP, as shown in FIG. 11, and the resilient arm 72 is held with respect to the lock arm 12 while accumulating a resilient force. Then, the contact portion 93 contacts the inner upper surface of the accommodating recess 31, so that an overlap margin between the movement restricting surface 94 of the protrusion 87 and the locking surface 29 of the lock projection 24 is determined automatically at a specified value.

The housing main body 11 then is fit into the receptacle 51 of the mating housing 50. The lock projection 24 initially slides in contact with the inclined surface 55 of the interfering portion 54 during the fitting process and then is pressed by the pressing surface 56 of the interfering portion 54. Thus, the lock arm 12 deforms into the deformation space 25, as shown in FIG. 12. The lock projection 24 moves beyond the interfering portion 54 when the housing main body 11 is connected properly to the mating housing 50. Thus, the lock arm 12 resiliently restores and the lock projection 24 enters the lock receiving portion 52 from below, as shown in FIG. 13. In this way, an upper part of the locking surface 29 of the lock projection 24 engages the engaging surface 53 of the lock receiving portion 52 to hold the two housings 10, 50 in the connected state.

Further, the auxiliary protrusion 91 on the upper end surface of the protrusion 87 is pressed down by the pressing surface 56 of the interfering portion 54, as shown in FIG. 13, when the housing main body 11 is connected properly to the mating housing 50. At this time, the protrusion 87 is kept in contact with the interfering portion 54 without following reciprocal displacements of the lock arm 12, and the contact portion 93 exits the accommodating recess 31. In this way, the detector 70 is kept at the standby position SP where the resilient arm 72 is separated from the lock arm 12 and held in contact with the mating housing 50. At the standby position SP, the resilient arm 72 is deformed by the interfering portion 54 and takes an inclined posture that is nearly horizontal.

Further, at the standby position SP, the guide surface 88 of the protrusion 87 faces the upper opening edge of the accommodating recess 31 on the rear of the lock projection 24 from behind while forming a small clearance, as shown in FIG. 13. That is, the upper opening edge of the accommodating recess 31 is accommodated within the height range of the guide surface 88 of the protrusion 87.

Subsequently, the rear surface of the rear portion 73 is pushed forward in the inserting direction ID to bring the detector 70 to the detection position DP. A pushing force on the detector 70 at the standby position SP releases a semi-locking state between the partial locking portions 85 and the restricting portions 23, and the resilient pieces 84 deform to move onto the restricting portions 23. Further, the guide surface 88 of the protrusion 87 and the auxiliary guide surface 92 of the auxiliary protrusion 91 successively come into sliding contact with the upper opening edge of the accommodating recess 31 during the movement toward the detection position DP, as shown in FIG. 14. As a result, the resilient arm 72 is deformed more and enters deeper into the deformation space 25 while the protrusion 87 is inserted into the accommodating recess 31 from behind.

The protrusion 87 is fit substantially entirely into the accommodating recess 31 and the auxiliary protrusion 91 is fit into the auxiliary recess 32 when the detector 70 reaches the detection position DP, as shown in FIG. 15. The protrusion 87 contacts the inner front surface of the accommodating recess 31 to prevent any further forward movement of the detector 70. Further, the resilient pieces 84 resiliently restore and the partial locking portions 85 contact the restricting portions 23 from the front, as shown in FIG. 18, to prevent a backward movement of the detector 70 from the detection position DP.

Figure 20:
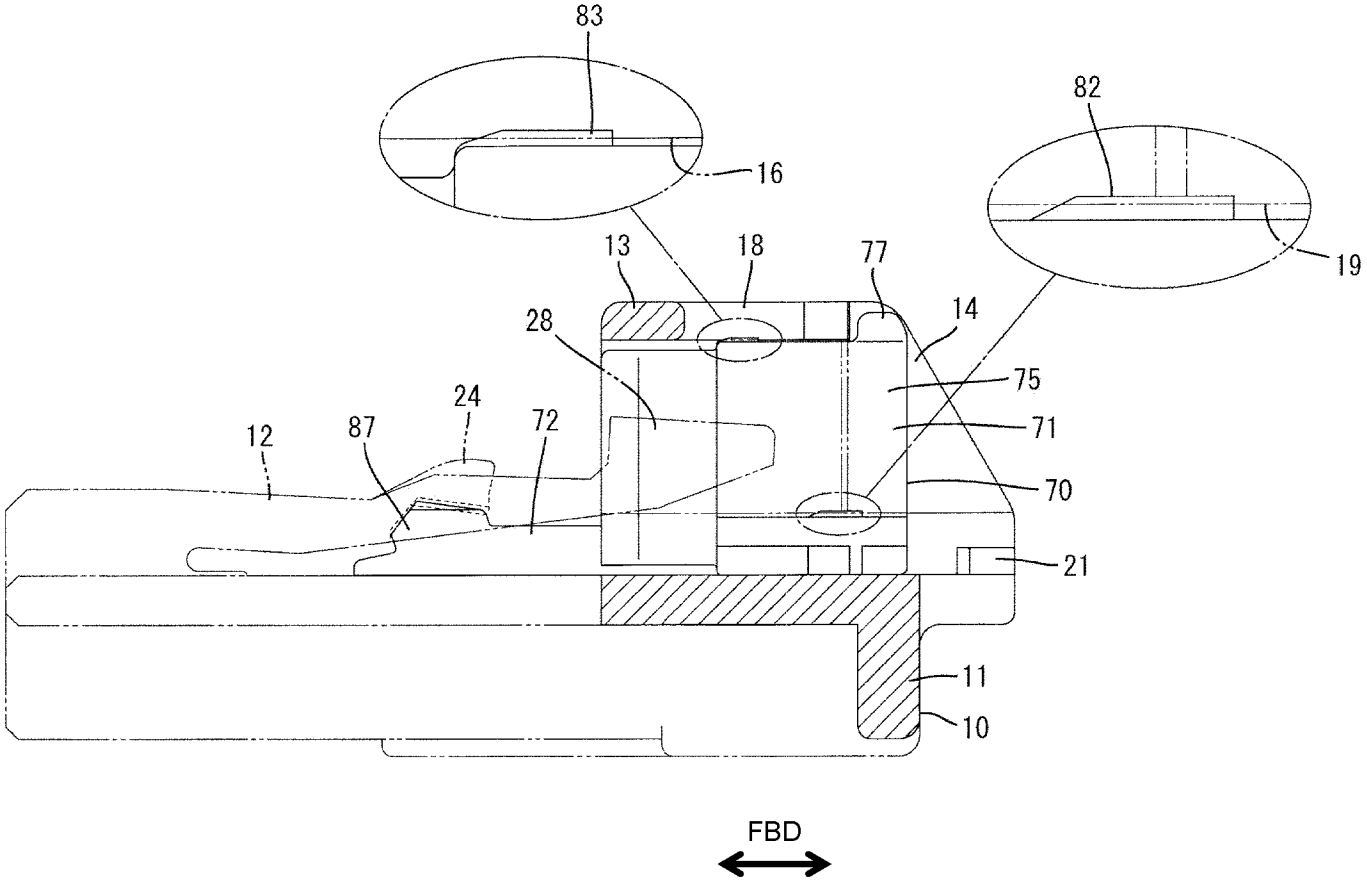
FIG. 20 is a side view with an essential part in section showing a state where the detecting member is mounted on the housing main body and the shake of a main portion is suppressed by first and second shake preventing portions.
Figure 21:
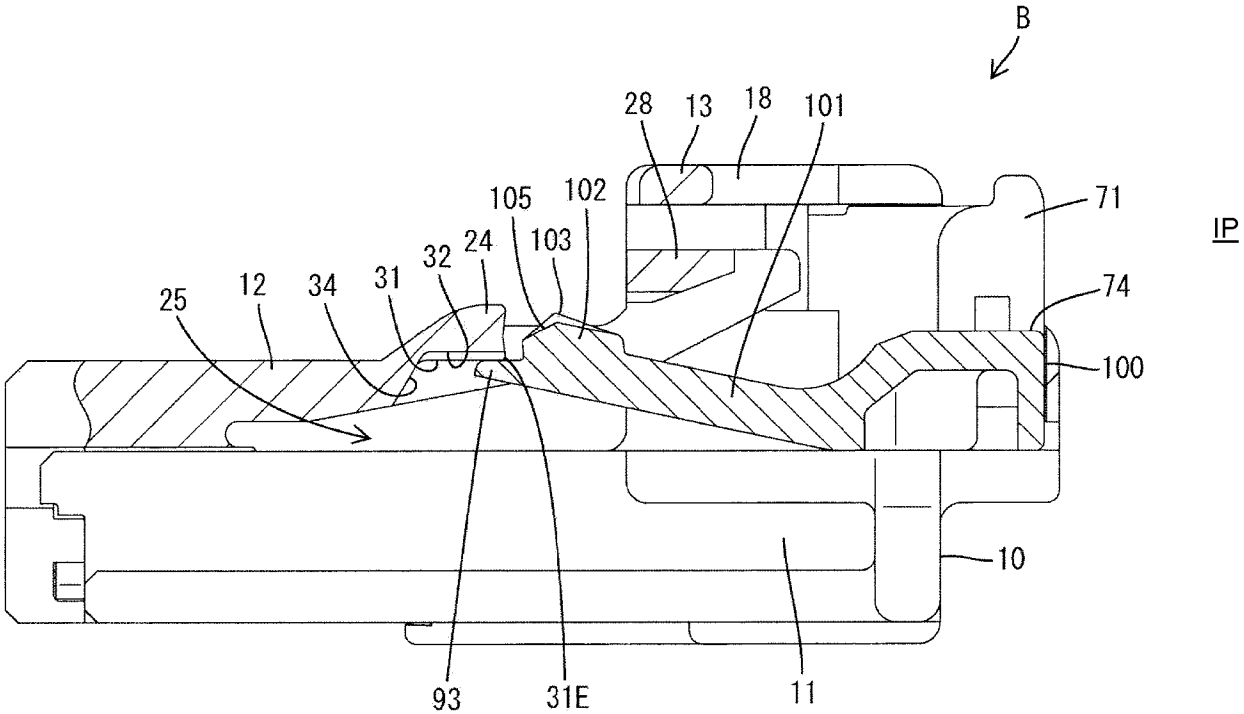
FIG. 21 is a section of the housing main body showing a state where the detecting member is mounted at the initial position, in a connector according to the second embodiment of the present invention.

The resilient arm 72 is held in a substantially horizontal posture at the detection position DP with a resilient force accumulated between the lock arm 12 and the housing main body 11, as shown in FIG. 15. The resilient arm 72 is inserted to a proper depth into the deformation space 25, thereby restricting resilient deformation of the lock arm 12 so that the two housings 10, 50 are held strongly in the connected state. The first shake preventing portions 82 are squeezed in sliding in contact with the inner upper surfaces of the guide grooves 19 and the second shake preventing portions 83 are squeezed in sliding contact with the lower surface of the covering wall 16 while moving the detector 70 from the initial position IP to the detection position DP via the standby position SP, thereby preventing inclination of the main portion 71 and ensuring stable movement of the detector 70. Further, the first and second shake preventing portions 82, 83 suppress shaking at each of the initial position IP, the standby position SP and the detection position DP, and the detector 70 is held on the housing main body 11 as shown in FIGS. 2 and 20.

The housing main body 11 might be kept at a partially connected position without being connected properly to the mating housing 50. Thus, the lock arm 12 is pressed by the pressing surface 56 of the interfering portion 54 and remains deformed in the deformation space 25, as shown in FIG. 12. An attempt may be made to push the detector 70 forward in the inserting direction ID in this state. However, the protrusion 87 will interfere with the lock projection 24 to prevent the resilient arm 72 from entering the deformation space 25 so that the detector 70 cannot move to the detection position DP. Thus, whether the housing main body 11 has been connected properly to the mating housing 50 can be detected based on whether the detector 70 is movable to the detection position DP.

The catches 77 are caught by fingers or a jig and the detector 70 is pulled back to separate the housings 10, 50. A backward pulling force on the detector 70 deforms the resilient pieces 84 so that the partial locking portions 85 disengage from the restricting portions 23. The detector 70 then is pulled back to the initial position IP. Subsequently, the fingers or the jig are inserted into the disengagement window 74 and press the disengaging portion 28 down. In this way, the lock projection 24 is separated from the lock receiving portion 52 and the lock arm 12 and the lock receiving portion 52 disengage. The housing main body 11 then is pulled apart from the mating housing 50 with the disengaging portion 28 pressed down so that the two housings 10, 50 can be separated from each other. The covering wall 16 is above the disengaging portion 28 and the cut portion 18 does not have a sufficient opening area to allow the entrance of the fingers or the jig.

The resilient arm 72 contacts the lock arm 12 in the height direction HD to apply a pre-load when the detector 70 is at the initial position IP. Accordingly, the resilient arm 72 is at a position to contact the lock arm 12 from behind and an overlap margin with the lock arm 12 is properly determined. Thus, detection reliability is very good even if dimensions of the detector 70 are not managed strictly.

The protrusion 87 of the resilient arm 72 overlaps the lock arm 12 along the deforming direction DD (in the height direction HD) when the detector 70 is at the standby position SP, and the guide surface 88 of the protrusion 87 slides contact with the lock arm 12 during movement to the detection position DP. Thus, the precision of position accuracy of the protrusion 87 at the standby position SP is required. However, the resilient arm 72 contacts the lock arm 12 in the height direction HD at the initial position IP. Therefore, position accuracy of the protrusion 87 advantageously can be satisfied.

The main portion 71 of the detector 70 is pressed to slide the detector 70 to the detection position DP. Shake preventing portions 82, 83 are provided on a slide-contact surface of the main portion 71 and are squeezed against a slide-contact surface of the housing main body 11 in the height direction HD while moving the detector 70. Thus, the detector 70 will not shake in the height direction HD and detection reliability of the detector 70 is good.

The first and second shake preventing portions 82, 83 are arranged two side by side in forward and backward directions FBD and in the height direction HD. Thus, the detector 70 will not incline in forward and backward directions FBD and a stable posture of the detector 70 is ensured.

The protrusion 87 is in the accommodating recess 31 of the lock arm 12 when the detector 70 reaches the detection position DP. Thus, the lock arm 12 and the detector 70 overlap along the height direction HD and the height of the connector can be reduced. The accommodating recess 31 is open toward the deformation space 25 of the lock arm 12 and toward the back, but not open on the front end connected to the housing main body 11. Therefore, the strength of the lock arm 12 is not reduced, and locking reliability is good.

The lock projection 24 projects along the deforming direction DD on the lock arm 12 and the accommodating recess 31 is open on the rear surface of the lock projection 24. Thus, a large opening area of the accommodating recess 31 is ensured along the deforming direction DD and within the height range of the lock projection 24.

The protrusion 87 and the lock projection 24 overlap along the deforming direction DD when the detector 70 is at the standby position SP. Thus, the corresponding height dimension of the connector can be further reduced.

The guide surface 88 of the protrusion 87 slides in contact with the upper end opening edge of the accommodating recess 31 to guide the protrusion 87 into the accommodating recess 31 as the detector 70 is moved from the standby position SP to the detection position DP. Thus, the detector 70 is moved stably.

The auxiliary protrusion 91 projects in the deforming direction DD on the upper end of the protrusion 87. The auxiliary guide surface 92 is continuous with the guide surface 88 and is formed on the front surface of the auxiliary protrusion 91. Thus, a large guide area is ensured in the deforming direction DD and dimensional management to have the protrusion 87 face the opening edge of the accommodating recess 31 at the standby position SP is facilitated. Further, the protrusion 87 and the auxiliary protrusion 91 are inserted into the accommodating recess 31 and the depth of the accommodating recess 31 is increased by the height of the auxiliary protrusion 91. However, the strength of the lock arm 12 is not reduced because a part of the inner upper surface of the accommodating recess 31 is recessed to form the auxiliary recess into which the auxiliary protrusion 91 is fit at the detection position DP. Thus, the depth of the entire accommodating recess 31 is not increased and a reduction in the strength of the lock arm 12 is avoided.

The protection wall 13 covers the surface of the disengaging portion 28 opposite the surface facing the deformation space 25 to prevent inadvertent operation of the disengaging portion 28. The disengaging portion 28 is operated by placing fingers or the jig through the disengagement window 74 at the rear portion 73 of the detector 70 when disengaging the lock arm 12. Thus, the lock arm 12 easily can be unlocked.

The catches 77 of the rear portion 73 can be caught with fingers or the jig to pull the detector 70 back to the initial position IP so that the disengaging portion 28 can be operated for separating the mating housing 50 from the housing main body 11. The catches 77 are at the opposite sides of the disengagement window 74 on the rear portion 73. Thus, space efficiency of the rear portion 73 is improved and the connector can be miniaturized.

A second embodiment of the invention is described with reference to FIGS. 21 to 27. A connector B of the second embodiment has a detector 100 made of synthetic resin, but with a shape that differs from the detector 70 of the above first embodiment. Other components are the same as or similar to the first embodiment. These similar components are denoted by the same reference signs, but are not described again.

As shown in FIGS. 24 to 27, a substantially rectangular block-shaped protrusion 102 projects up near a front part of a resilient arm 101 of the detector 100. An auxiliary protrusion 103 having substantially the same shape as in the first embodiment projects up on the upper end surface of the protrusion 102. The auxiliary protrusion 103 is in the form of a rib extending in forward and backward directions FBD in a substantially widthwise central part of the upper or outer end surface of the protrusion 102. Thus, the auxiliary protrusion 103 is narrower than the protrusion 102.

A projecting distance of the auxiliary protrusion 103 along the deforming direction DD (the height direction HD) from the protrusion 102 is smaller than the projecting distance of the protrusion 102 from the resilient arm portion 101 along the deforming direction DD. Further, the upper surface of the auxiliary protrusion 103 is tapered to incline down or in toward the back. The auxiliary protrusion 103 is fit into an auxiliary recess 32 when the protrusion 102 is fit into an accommodating recess 31.

Figure 23:
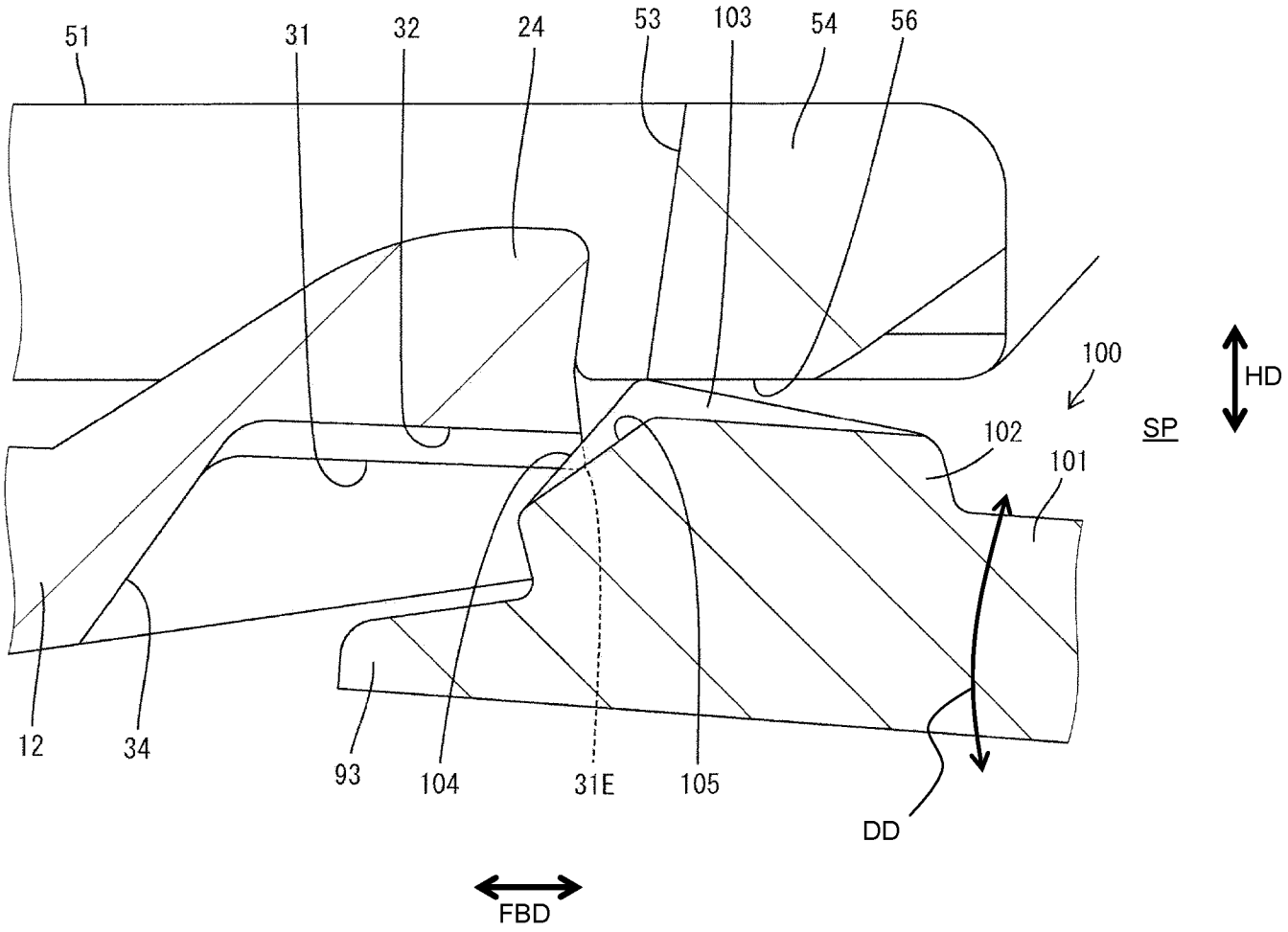
FIG. 23 is a partial enlarged view of FIG. 22.
Figure 24:
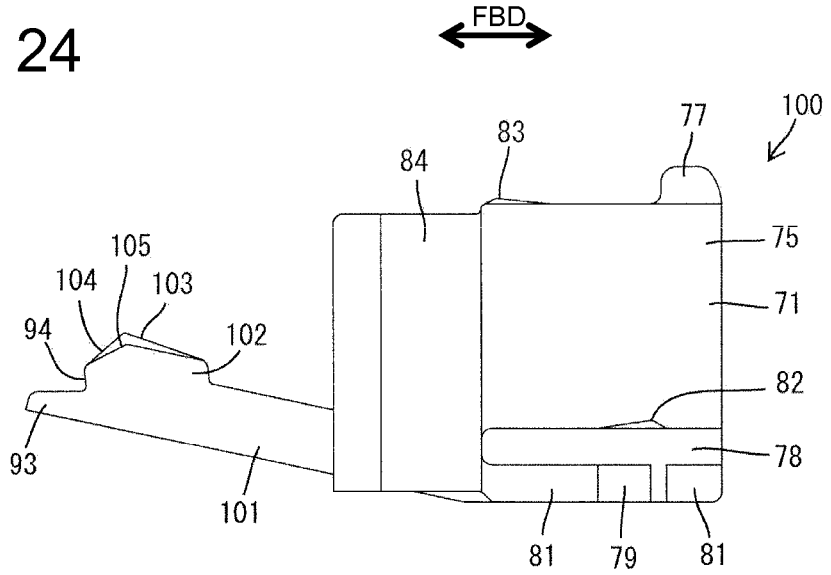
FIG. 24 is a side view of the detecting member.
Figure 25:
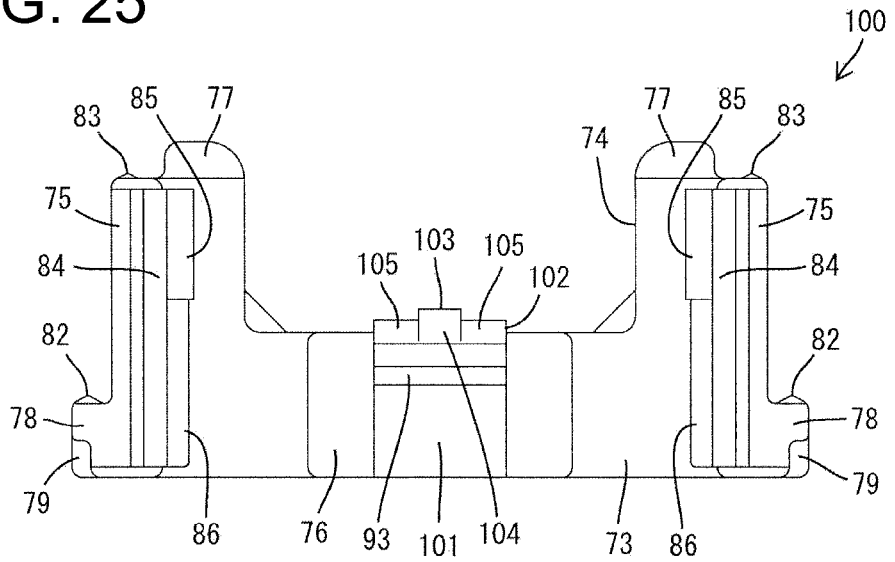
FIG. 25 is a front view of the detecting member.
Figure 26:
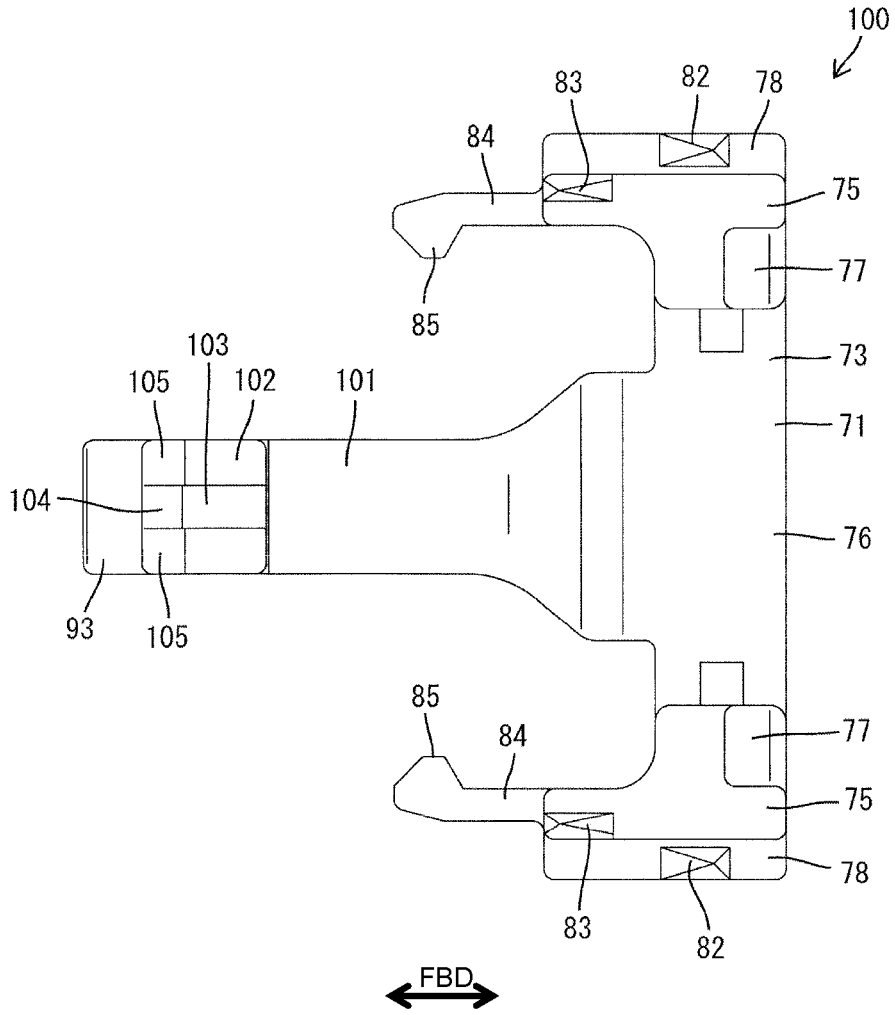
FIG. 26 is a plan view of the detecting member.

A steeply inclined surface 104 is formed at central area of the front of the protrusion 102 corresponding to the auxiliary protrusion 103 in a width direction and is inclined with respect to forward and backward directions FBD (moving directions ID of the detector 100 between a standby position SP and a detection position DP) and is continuous and flush with the front surface of the auxiliary protrusion 103. Left and right moderately inclined surfaces 105 are formed on the front of the protrusion 102 at areas not corresponding to the auxiliary protrusion in the width direction WD and hence in areas other than the steeply inclined surface 104. The moderately inclined surfaces 105 have angles of inclination with respect to forward and backward directions FBD that are smaller than the steeply inclined surface 104. That is, the front surface of the protrusion 102 comprises the steeply inclined surface 104 and the moderately inclined surfaces 105 located laterally at left and right sides of the steeply inclined surface 104 as shown in FIG. 23. The moderately inclined surfaces 105 are receded to form steps with respect to the steeply inclined surface 104 (i.e. inclined more backward to be flatter than the steeply inclined surface 104).

Figure 22:
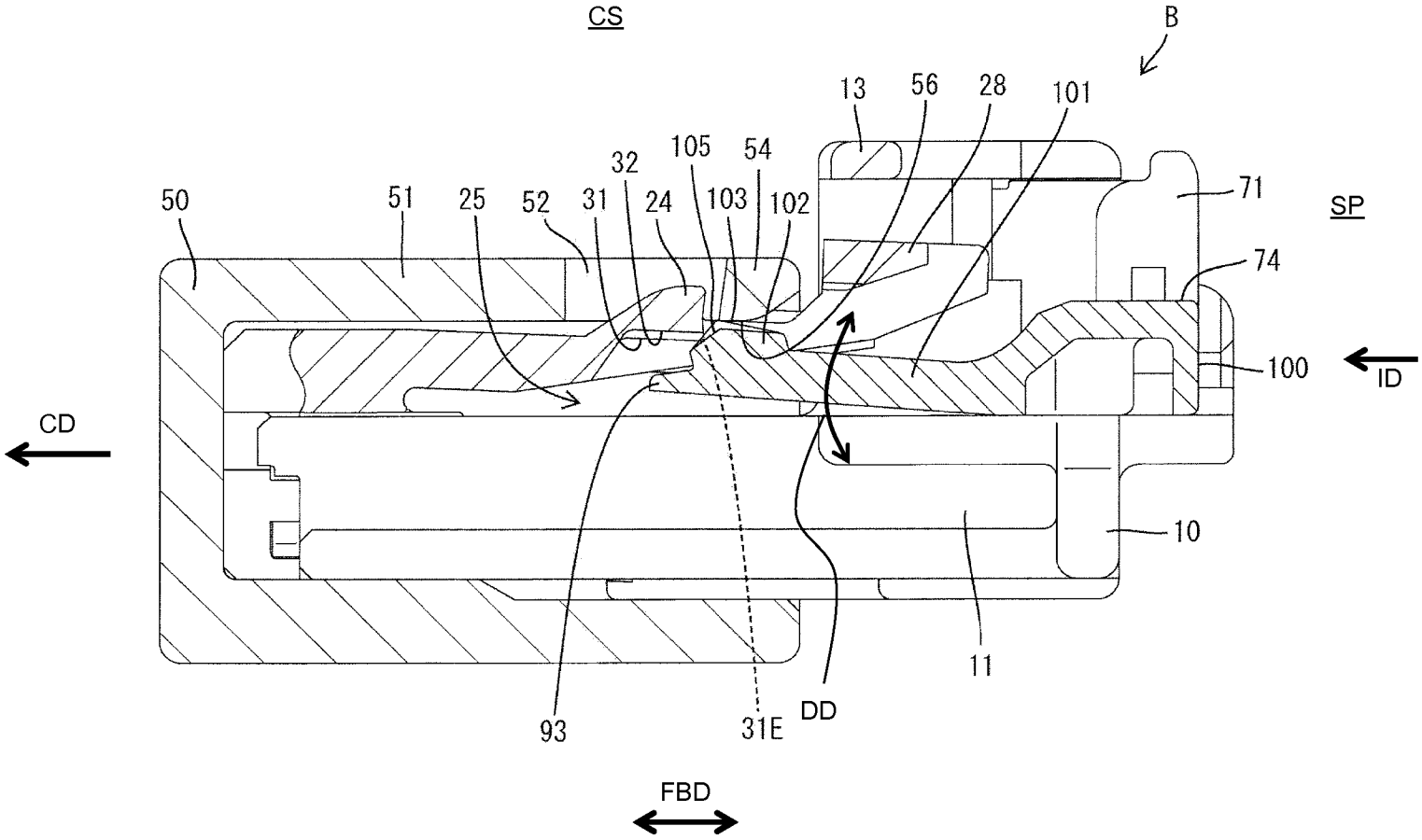
FIG. 22 is a section showing a state where a guide surface of the lock projection is held in sliding contact with an upper end opening edge of an accommodating recess in the process of moving the detecting member toward a detection position.

As shown in FIGS. 22 and 23, when the detector 100 is at the standby position SP, the moderately inclined surfaces of the protrusion 102 substantially face an upper or outer end opening edge 31E of the accommodating recess 31 on the rear surface of a lock projection 24. Further, in the process of moving the detector 100 from the standby position SP to the detection position DP, the moderately inclined surfaces 105 slide contact with the upper end opening edge 31E of the accommodating recess 31, as shown in FIG. 23, and, accordingly, the resilient arm 101 is inclined down. Further, the protrusion 102 is in the accommodating recess 31 when the detector 100 reaches the detection position DP. At least one inclined guided surface 34 is formed on the inner surface of the accommodating recess 31 and faces the steeply inclined surface 104 of the protrusion 102 at the detection position DP.

The auxiliary protrusion 103 projecting from the upper surface of the protrusion 102 is pressed in or down by at least one pressing surface 56 of an interfering portion 54 when a housing main body 11 is connected properly to a mating housing 50. The protrusion 102 maintains a contact state with the interfering portion 54 without following reciprocal displacements of a lock arm 12 and a contact portion 93 exits from the accommodating recess 31. In this way, the detector 100 is kept at the standby position SP where the resilient arm 101 is separated from the lock arm 12 and held in contact with the mating housing 50.

The resilient arm 101 is deformed resiliently by the interfering portion 54 when the detector 100 is at the standby position SP and takes an inclined posture approximate to a horizontal posture, as shown in FIGS. 22 and 23. At the standby position SP, the moderately inclined surfaces 105 of the protrusion 102 substantially face the upper or outer end opening edge 31E of the accommodating recess 31 on the rear surface of the lock projection 24 from behind while forming a small clearance. Thus, the upper end opening edge 31E of the accommodating recess 31 is accommodated within the height range of the moderately inclined surfaces 105 of the protrusion 102.

The rear surface of a rear portion 73 of the detector 100 is pushed forward in the inserting direction ID to move the detecting member 100 towards the detection position DP after the housing main body 11 is connected properly to the mating housing 50. The moderately inclined surfaces 105 of the protrusion 102 slide in contact with the upper end opening edge 31E of the accommodating recess 31 during this forward movement, as shown in FIGS. 22 and 23. Resistance due to sliding contact is suppressed to a low level during this sliding process because the angle of inclination of the moderately inclined surfaces 105 with respect to forward and backward directions FBD is smaller than the steeply inclined surface 104.

The sliding contact of the moderately inclined surfaces 105 with the upper end opening edge 31E of the accommodating recess 31 deforms the resilient arm 101 in or down to a larger extent and more deeply into a deformation space 25 and the protrusion 102 is accommodated into the accommodating recess 31 from behind. The protrusion 102 is fit substantially entirely in the accommodating recess 31 and the auxiliary protrusion 103 is fit in the auxiliary recess 32 when the detector 100 reaches the detection position DP. The contact of the protrusion 102 with the inner front surface of the accommodating recess 31 prevents any further forward movement of the detector 100.

The narrow auxiliary protrusion 103 of the connector B of this second embodiment projects in the height direction on the protrusion 102 and a part of the inner surface of the accommodating recess 31 is recessed to form the auxiliary recess 32 for receiving the auxiliary protrusion 103 at the detection position DP. The steeply inclined surface 104 is formed at an area of the front surface of the protrusion 102 corresponding to the auxiliary protrusion 103 in the width direction WD and is inclined with respect to forward and backward directions FBD. The steeply inclined surface 104 is substantially continuous and flush with the front surface of the auxiliary protrusion 103. Further, the areas of the front surface of the protrusion 102 not corresponding to the auxiliary protrusion 103 in the width direction WD form the moderately inclined surfaces 105 and have a smaller angle of inclination with respect to forward and backward directions FBD than the steeply inclined surface 104. The moderately inclined surfaces 105 are receded more than the steeply inclined surface 104. The moderately inclined surfaces 105 slide in contact with the opening edge 31E of the accommodating recess 31 while moving the detector 100 from the standby position SP to the detection position DP, thereby guiding the insertion of the protrusion 102 into the accommodating recess 31.

The protrusion 102 and the auxiliary protrusion 103 overlap with the lock projection 24 along the deforming direction DD or the height direction HD when the detector 100 is at the standby position SP. Thus, the height of the connector B is reduced. Further, the moderately inclined surfaces 105 slide in contact with the opening edge 31E of the accommodating recess 31 to guide the protrusion 102 and the auxiliary protrusion 103 into the accommodating recess 31 in the process of moving the detector 100 from the standby position SP to the detection position DP.

Figure 27:
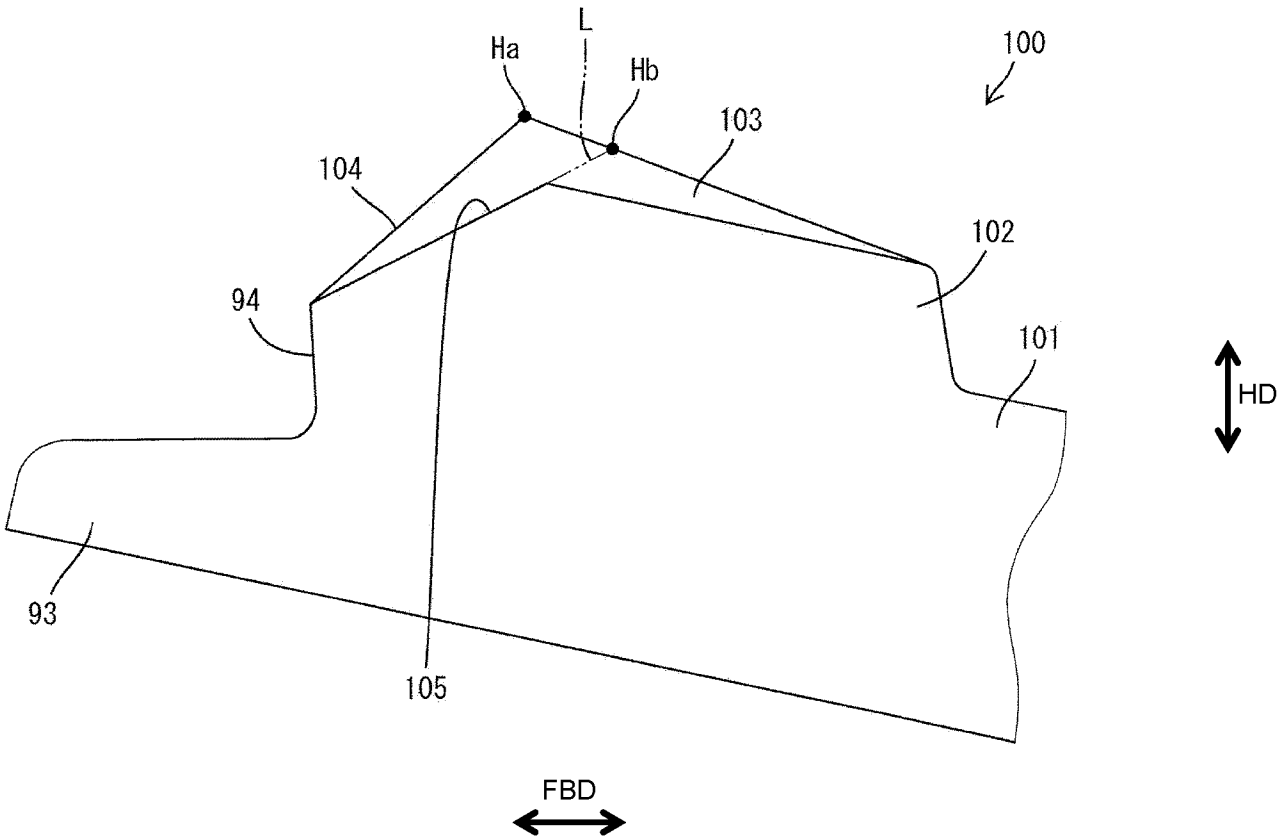
FIG. 27 is a partial enlarged view of FIG. 24.

The moderately inclined surfaces 105 may be formed by making the angle of inclination smaller to make the entire area of the front surface of the protrusion 102 and that of the front surface of the auxiliary protrusion 103 substantially flat as shown by imaginary line L in FIG. 27. However, if the moderately inclined surfaces 105 are formed in this way, the upper surface of the auxiliary protrusion 103 is inclined down toward the back. Thus, the height Hb of the upper end of the auxiliary protrusion 103 becomes lower than the height Ha of the upper end of the auxiliary protrusion 103. Therefore, an overlap margin between the auxiliary protrusion 103 and the lock projection 24 in the height direction HD is reduced and the height of the connector B cannot be reduced sufficiently.

However, the moderately inclined surfaces 105 are formed only in the areas of the front surface of the protrusion 102 not corresponding to the auxiliary protrusion 103 in the width direction WD of the connector B. Thus, the height Ha of the upper end of the auxiliary protrusion 103 is not changed by the presence of the moderately inclined surfaces 105 and the overlap margin between the auxiliary protrusion 103 and the lock projection 24 in the height direction is not reduced. Therefore, there is no problem in reducing the height of the connector B.

Figure 28:
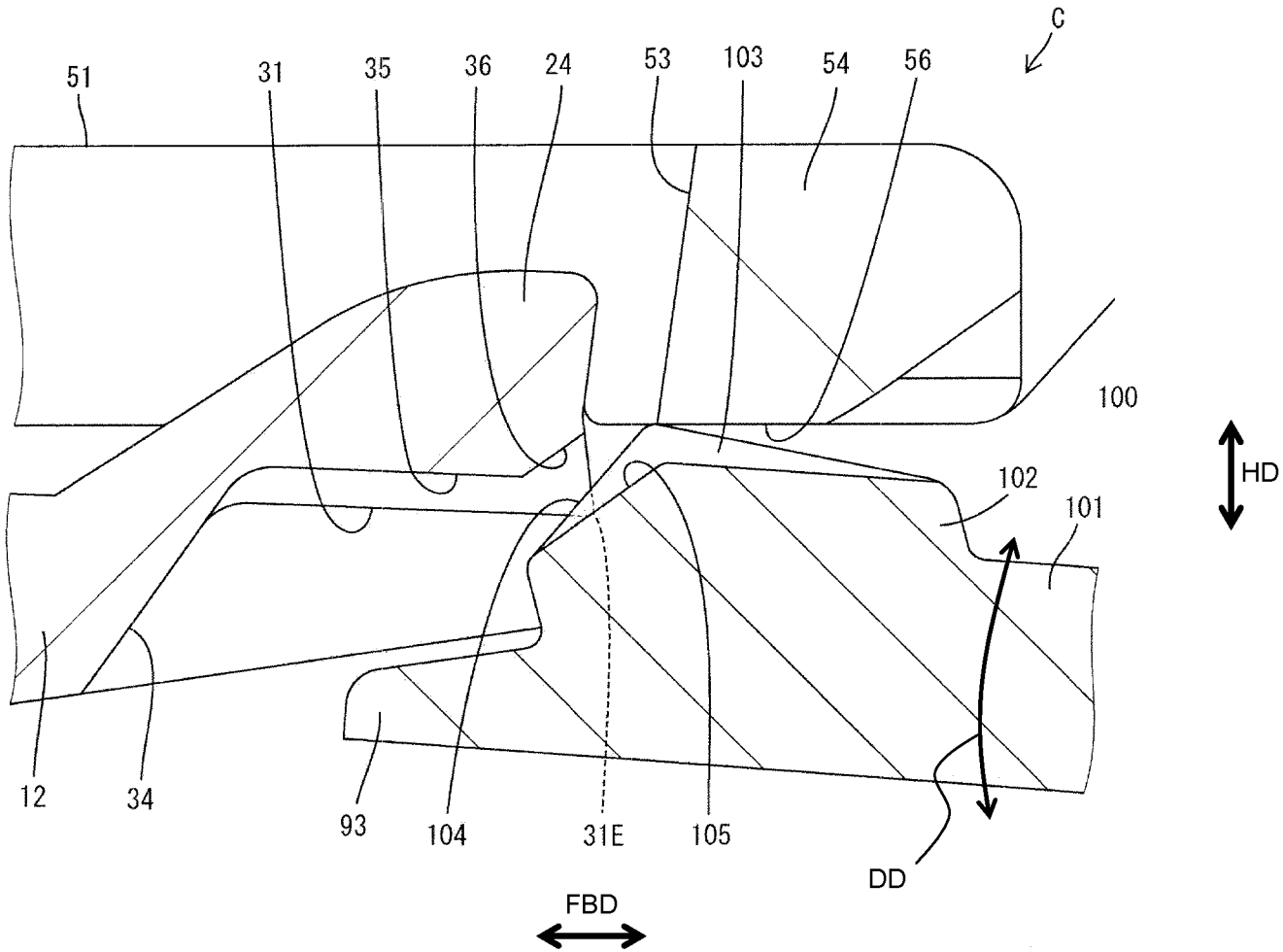
FIG. 28 is a partial enlarged section, showing a state where a guide surface of the lock projection is held in sliding contact with an upper end opening edge of an accommodating recess in the process of moving the detecting member toward a detection position, in a connector according to the third embodiment of the present invention.

A third embodiment of the invention is described with reference to FIG. 28. A connector C of this third embodiment, has an auxiliary recess 35 that differs from the auxiliary recess 32 formed on the inner upper surface of the accommodating recess 31 of the lock arm 12 in the connector B of the second embodiment. Other components are the same as or similar to the first embodiment. These components are denoted by the same reference signs but are not described again.

A rear end part of the accommodating recess 35 of the third embodiment is cut obliquely to form at least one escaping portion 36 that is open in or down and back. The escaping portion 36 avoids interference of an auxiliary protrusion 103 with a rear end part of the lower surface of a lock projection 24 as the moderately inclined surfaces 105 slide in contact with an opening edge 31E. Therefore, a guide function by the sliding contact of the opening edge 31E and the moderately inclined surfaces 105 is displayed continuously until the insertion of the auxiliary protrusion 103 into the auxiliary recess 35 (insertion of a protrusion 102 into an accommodating recess 31) is complete.

The present invention is not limited to the above described and illustrated embodiment. For example, the following embodiments are also included in the technical scope of the present invention.

The detecting member may be configured to be incapable of restricting the resilient deformation of the lock arm when the detector reaches the detection position.

The accommodating recess may not be dimensioned and shaped so that the protrusion can fit therein or may be dimensioned so that the protrusion is loosely fit therein.

The accommodating recess may be open backward on a part of the lock arm other than the lock projection.

The shake preventing portions may be formed on the housing main body instead of on the main portion or may be formed on both the main portion and the housing main body.

A plurality of shake preventing portions may be arranged substantially side by side on the same axes in forward and backward directions FBD and/or the height direction HD.

Three or more shake preventing portions may be arranged substantially side by side in forward and backward directions FBD and/or the height direction HD.

A plurality of auxiliary protrusions may be formed on the upper end of the protrusion. For example, a pair of auxiliary protrusions may be formed on opposite widthwise sides of the upper end of the protrusion. In this case, a plurality of auxiliary recesses may be formed at positions of the accommodating recess corresponding to the auxiliary protrusions.

The guide surface and the guide inclined surface may be curved inclined surfaces.

What is claimed is:

1. A connector, comprising:

a housing main body be connected to a mating housing along a connecting direction;

a lock arm projecting from the housing main body and being resiliently deformable in a deforming direction intersecting the connecting direction, a deformation space between the lock arm and the housing main body, the lock arm being formed with a lock projection projecting in the deforming direction from a side of the lock arm opposite the deformation space, the lock projection being configured to fit into a lock receiving portion of the mating housing at proper connection to hold the housing main body connected to the mating housing in a connected state, the lock arm including an accommodating recess that is open toward the deformation space and that is open on a rear surface of the lock projection; and a detector mounted on the housing main body for movement from an initial position to a detection position via a standby position and configured such that movement in a movement direction is restricted at the initial position by contact of the detector with the lock arm before the housing main body is connected to the mating housing, a movement restricted state at the initial position is released and the detector is kept at the standby position to face the accommodating recess along the movement direction when the housing main body is connected properly to the mating housing, and the detector reaches the detection position by a displacement operation in the movement direction from the standby position, whereby at part of the detector is inserted into the accommodating recess.

2. The connector of claim 1, wherein the lock arm is cantilevered back from a front end part of the housing main body.

3. The connector of claim 1, wherein a protrusion projects in the deforming direction near an end part of the detector and is insertable into the accommodating recess at the detection position and overlaps the lock projection in the deforming direction at the standby position.

4. The connector of claim 3, wherein an inclined guide surface is formed on a front of the protrusion at a position substantially facing an opening edge of the accommodating recess on the rear surface of the lock projection in forward and backward directions at the standby position, the inclined guide surface sliding in contact with the opening edge of the accommodating recess while moving to the detection position from the standby position, thereby guiding insertion of the protrusion into the accommodating recess.

5. The connector of claim 3, wherein an auxiliary protrusion projects in the deforming direction on a part of a projecting end of the protrusion.

6. The connector of claim 5, wherein an auxiliary guide surface continuous with the guide surface is formed on a front of the auxiliary protrusion; and/or a part of the inner surface of the accommodating recess is recessed to form an auxiliary recess into which the auxiliary protrusion is to be fit at the detection position.

7. The connector of claim 3, wherein:

a narrow auxiliary protrusion projects in the deforming direction on the protrusion; and a part of the inner surface of the accommodating recess is recessed to form an auxiliary recess into which the auxiliary protrusion is to be fit at the detection position.

8. The connector of claim 7, wherein an area of the front surface of the protrusion corresponding to the auxiliary protrusion in a width direction is a steeply inclined surface inclined with respect to forward and backward directions and/or continuous and flush with the front surface of the auxiliary protrusion; and an area of the front surface of the protrusion not corresponding to the auxiliary protrusion in the width direction is a moderately inclined surface having a smaller angle of inclination with respect to forward and backward directions than the steeply inclined surface and receded more than the steeply inclined surface.

9. The connector of claim 8, wherein the moderately inclined surface slides in contact with the opening edge of the accommodating recess in the process of moving the detector from the standby position to the detection position, thereby guiding insertion of the protrusion into the accommodating recess.

10. The connector of claim 9, wherein the accommodating recess is cut obliquely to form at least one escaping portion for avoiding interference of the auxiliary protrusion with the lock projection while moving the detecting member from the standby position to the detection position.

11. The connector of claim 1, wherein the detector is configured such that (i) the insertion movement is restricted at the initial position by the contact of a resilient arm of the detector with the lock arm before the housing main body is connected to the mating housing; (ii) the movement restricted state at the initial position is released and the detector is capable of reaching the detection position where the resilient arm enters the deformation space by being displaced from the initial position when the housing main body is properly connected to the mating housing; and/or the resilient arm is held in contact with the lock arm in the deforming direction at the initial position to apply a pre-load to the lock arm.

* * * * *